US009303403B2

(12) United States Patent
Bolin

(10) Patent No.: US 9,303,403 B2
(45) Date of Patent: Apr. 5, 2016

(54) COMPOSITE PANELS AND METHODS AND APPARATUS FOR MANUFACTURE AND INSTALLTION THEREOF

(71) Applicant: Joel W. Bolin, Hempstead, TX (US)

(72) Inventor: Joel W. Bolin, Hempstead, TX (US)

(73) Assignee: Joel W. Bolin, Hempstead, TX (US)

( * ) Notice: Subject to any disclaimer, the term of this patent is extended or adjusted under 35 U.S.C. 154(b) by 0 days.

(21) Appl. No.: 13/741,029

(22) Filed: Jan. 14, 2013

(65) Prior Publication Data

US 2014/0069050 A1 Mar. 13, 2014

Related U.S. Application Data

(63) Continuation-in-part of application No. 12/459,156, filed on Jun. 26, 2009, now Pat. No. 8,353,144.

(51) Int. Cl.

| | |
|---|---|
| ***E04C 1/00*** | (2006.01) |
| ***E04C 2/26*** | (2006.01) |
| ***E04F 13/08*** | (2006.01) |
| ***E04F 13/14*** | (2006.01) |

(52) U.S. Cl.

CPC ..... *E04C 2/26* (2013.01); *E04F 13/0862* (2013.01); *E04F 13/147* (2013.01); *Y10T 428/2443* (2015.01); *Y10T 428/24355* (2015.01)

(58) Field of Classification Search

CPC ..... E04C 2/26; E04F 13/0862; E04F 13/147
USPC ..... 52/309.4, 794.1, 586.1, 387, 309.1, 52/309.5, 309.8, 309.9, 389, 782.1, 586.2, 52/384, 385, 388

See application file for complete search history.

(56) References Cited

U.S. PATENT DOCUMENTS

| | | | | |
|---|---|---|---|---|
| 3,646,715 | A | 3/1972 | Pope | |
| 3,868,801 | A * | 3/1975 | Weiner | 52/309.5 |
| 4,299,069 | A * | 11/1981 | Neumann | E04C 2/30 52/309.4 |
| 4,307,140 | A * | 12/1981 | Davis | B29C 37/0082 156/276 |
| 4,525,965 | A * | 7/1985 | Woelfel | E04C 2/384 428/446 |
| 4,589,241 | A * | 5/1986 | Volpenhein | 52/315 |
| 4,946,335 | A | 8/1990 | King et al. | |
| 5,004,505 | A | 4/1991 | Alley et al. | |
| 5,110,361 | A | 5/1992 | Alley et al. | |
| 5,427,252 | A | 6/1995 | Teegarden et al. | |
| 5,431,469 | A | 7/1995 | Obno et al. | |
| 5,501,049 | A * | 3/1996 | Francis et al. | 52/387 |
| 6,041,567 | A * | 3/2000 | Passeno | 52/749.11 |
| 6,345,850 | B1 | 2/2002 | Foust | |

(Continued)

*Primary Examiner* — Mark Wendell
(74) *Attorney, Agent, or Firm* — The Kubiak Law Firm, PLLC

(57) ABSTRACT

Panels usable for construction of a surface, to provide the surface with a desired appearance, durability, water, air, and fire resistance, dimensions, and weight include a layer of substrate material having first and second sides. Finish elements are positioned on the first side, while a backing material is positioned on the second side, such that the substrate bonds the finish elements to the backing material. Particulate material can also be included, such as within spaces between finish elements. Manufacture of such panels can include use of a vacuum system that acquires finish elements in a selected orientation, acquires particulate material into spaces unoccupied by finish elements, then deposits the arranged finish elements and particulate material into a mold for subsequent manufacturing steps. Use of lightweight, durable materials, such as magnesium oxide, can enable panels having a reduced thickness and weight to be manufactured, without sacrificing durability or longevity.

4 Claims, 13 Drawing Sheets

(56) References Cited

U.S. PATENT DOCUMENTS

| | | | |
|---|---|---|---|
| 6,871,394 | B2 | 3/2005 | Barretto et al. |
| 6,913,819 | B2 | 7/2005 | Wallner |
| 7,007,942 | B1 | 3/2006 | Stearns et al. |
| 7,017,751 | B2 | 3/2006 | Clark et al. |
| 7,292,427 | B1 | 11/2007 | Murdoch et al. |
| 7,407,545 | B2 | 8/2008 | Wallner |
| 7,481,472 | B2 | 1/2009 | Cawley et al. |
| 7,543,868 | B1 | 6/2009 | Mongan |
| 7,740,700 | B2 | 6/2010 | Wallner |
| 8,080,513 | B2 | 12/2011 | McGinnis et al. |
| 8,082,755 | B2 | 12/2011 | Angel et al. |
| 8,182,605 | B2 | 5/2012 | Wallner |
| 8,290,624 | B2 | 10/2012 | Hjornet |
| 8,852,724 | B2 * | 10/2014 | Calmes ..... 428/178 |
| 2003/0143062 | A1 | 7/2003 | Bennison |
| 2003/0144853 | A1 | 7/2003 | Stehouwer et al. |
| 2004/0126602 | A1 | 7/2004 | Wallner |
| 2005/0210790 | A1 | 9/2005 | Wallner |
| 2006/0070321 | A1 | 4/2006 | Au |
| 2006/0242785 | A1 | 11/2006 | Cawley et al. |
| 2008/0257222 | A1 | 10/2008 | Wallner |
| 2010/0135760 | A1 | 6/2010 | Hjornet |
| 2010/0222457 | A1 | 9/2010 | Wallner |
| 2010/0297411 | A1 | 11/2010 | Tsai et al. |
| 2012/0027550 | A1 | 2/2012 | Bellacicco et al. |
| 2012/0326458 | A1 | 12/2012 | Yeh et al. |

* cited by examiner

COMPOSITE PANELS AND METHODS AND APPARATUS FOR MANUFACTURE AND INSTALLTION THEREOF

CROSS-REFERENCE TO RELATED APPLICATIONS

The present application is a continuation-in-part application that claims priority to the United States application for patent, filed Jun. 26, 2009, having the application Ser. No. 12/459,156, the entirety of which is incorporated herein by reference.

FIELD

Embodiments usable within the scope of the present disclosure relate, generally, to manufactured panels used in the construction of buildings and building components, namely, in the construction of interior and/or exterior walls, floors, ceilings, roofing, or any other surface. More specifically, embodiments usable within the scope of the present disclosure relate to pre-fabricated panels having exterior elements thereon to provide the panels with a desired appearance, such elements able to be lighter and thinner than conventional masonry counterparts due to the structural characteristics of the panel. Embodiments of the present disclosure also relate to manufacturing processes usable to create such panels.

SUMMARY

Embodiments usable within the scope of the present disclosure relate to panels (e.g., prefabricated panels having selected dimensions and materials) usable for construction of a surface, such as an exterior wall, an interior wall, a floor, a ceiling, a roof, a counter, a backsplash, or other similar types of surfaces. A layer of substrate material (e.g., a curable polymeric material and/or an adhesive) is provided between a backing material and at least one finish element to bond the one or more finish elements to the backing material. In an embodiment, the finish element(s) and/or backing material can include magnesium oxide, to provide the finished panel with a reduced thickness and/or a reduced weight. Finish elements that include a body of magnesium oxide can be provided with an appearance that simulates natural brick, such as through application of an artificial texture (e.g., using a grinding wheel) and application of a coating comprising cement (e.g., Portland and/or magnesium cement), clay (e.g., clay dust), and a light aggregate (e.g., sand). Completed panels can be installed as part of any desired surface, and can provide desirable water, air, fire, and sound resistance, and thermal insulation, and structural durability and longevity equal to or greater than that of conventional masonry walls.

Embodiments usable within the scope of the present disclosure also relate to methods for manufacturing such panels that can include associating a vacuum device with a surface (e.g., a screen or other generally flat, porous medium) adapted to retain panel elements in association therewith. Force from the vacuum device can be used to associate a plurality of finish elements with a first zone of the surface, the finish elements having an arrangement corresponding to that of a completed panel. For example, stacks of finish elements in a storage receptacle (e.g., a magazine) can be provided in a desired orientation, such that a single layer of finish elements can be associated with a surface of the vacuum device, while one or more biasing and/or lifting apparatus can move the remaining finish elements toward the exterior of the storage receptacle for subsequent access.

The presence of the finish elements on the surface of the vacuum device obstructs the first zone, defining a second zone between the finish elements. Force from the vacuum device can then be used to associate particulate material with the second zone, thereby forming an assembly of panel components that can be transferred to a mold device in an orientation corresponding to that of a completed panel. A polymeric substrate and backing material can be provided to the panel elements, under compression, to form the completed panel. In an embodiment, panel border members can be associated with the vacuum device during the assembly and/or transfer process to provide a barrier that prevents movement of particulate material beyond a desired edge prior to completion of the molding/curing process.

BRIEF DESCRIPTION OF THE DRAWINGS

In the detailed description of various embodiments of the present invention presented below, reference is made to the accompanying drawings, in which.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Figure 1:
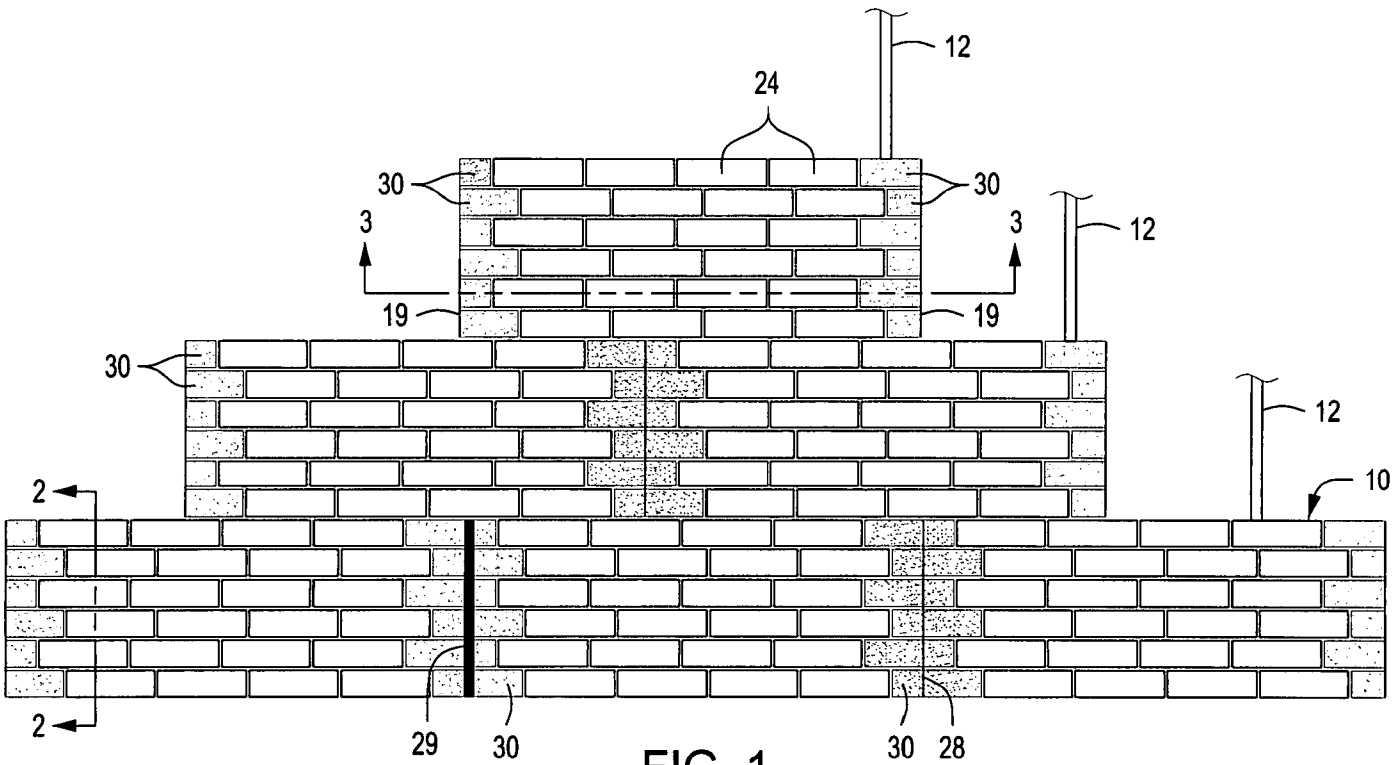
FIG. 1 is an elevational view illustrating an embodiment of panels usable within the scope of the present disclosure, installed on a framework of a building structure.

Referring now to FIG. 1, a plurality of panels 10, usable within the scope of the present disclosure are shown secured to framework members 12 to form an exterior wall of a building. For illustrative purposes, FIG. 1 depicts only portions of the framework of the building structure.

While FIG. 1 depicts panels that are usable to form the finish or external facade of the exterior walls of a building, it should be understood that panels could be provided with materials suitable for use with interior walls of buildings, floors, ceilings, roofs, counters, backsplashes, or any other interior or exterior surface. Embodiments of the present panel can be weather resistant and serve as moisture barriers, thus providing resiliency to the exterior of a building, while enabling any interior wall of a building that might be subject to contact by water, such as bathrooms, kitchens, laundry rooms, etc. to be provided with moisture barriers to minimize potential damage by water, and to promote efficient and effective cleaning of the walls. For example, embodied panels can be provided with various types of water resistant surface finish materials, such as ceramic tile, glass or polymer tile, and polymer wall surfaces, for example. Embodiments of panels usable within the scope of the present disclosure can have a thermal insulating quality that exceeds the thermal insulating characteristics of conventional masonry walls, can have a thinner profile than conventional walls, and can be installed in significantly less time when compared to the installation of the various layers (substrate, vapor barrier, insulation, brick, mortar, etc.) of a wall required by building codes and conventional methods. Due to the lightweight and/or thinner nature of various embodied panels, the foundation of a building structure can also be of lighter weight construction (thus providing weight and cost savings), because the foundation would not be required to support the weight of a typical brick and mortar wall.

The term "masonry" as used herein is intended to encompass a wide range of materials, including, without limitation, natural and manufactured stone materials, artificial stone materials, and special effect finish or facade materials usable to provide visible wall surfaces with a desired appearance. The terms "brick members", "thin bricks", "finish elements" and "thin masonry elements," as used herein, are intended to encompass any of a number of thin masonry or masonry-like members of rectangular, square, round, ovoid, triangular or other suitable configuration.

For example, FIG. 1 depicts panels having external finish elements, e.g., masonry or facade members, thereon to provide the panels with the external appearance of the conventional bricks of a masonry or masonry veneer wall structure. However any natural, manufactured, or artificial veneer or element can be provided to the panels without departing from the scope of the present disclosure. Where natural or artificial stone is used as a finish material it can be provided in a "repeating pattern" such that individual finish elements can be positioned at specifically designed locations, e.g., within a jig, magazine, or similar frame or retention element, during panel manufacture. The term "facade members" is intended to include a wide variety of possible surface materials, such as ceramic tile, composite materials including wood, various polymer materials, glass, rubber like materials, etc.

Figure 2:
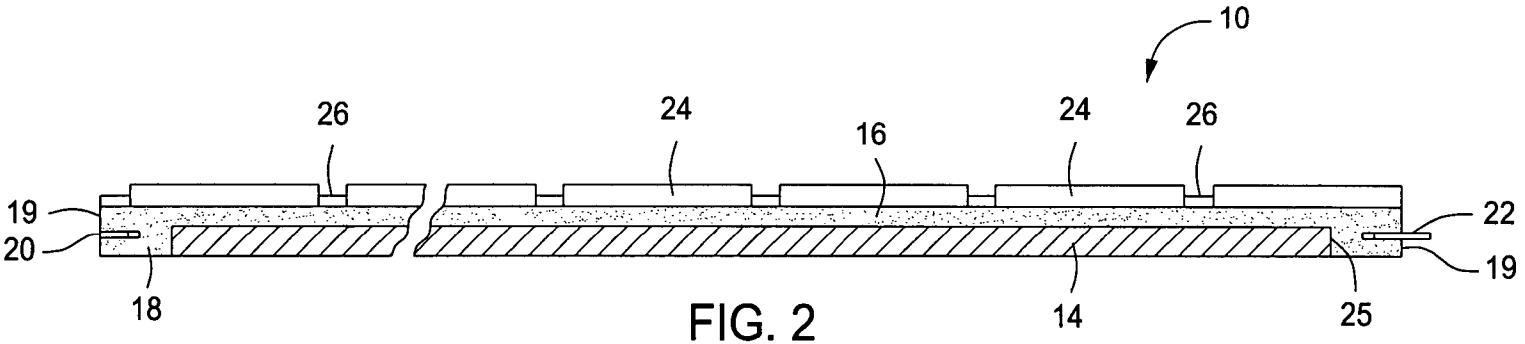
FIG. 2 is a vertical sectional view taken along line 2-2 of FIG. 1.
Figure 3:
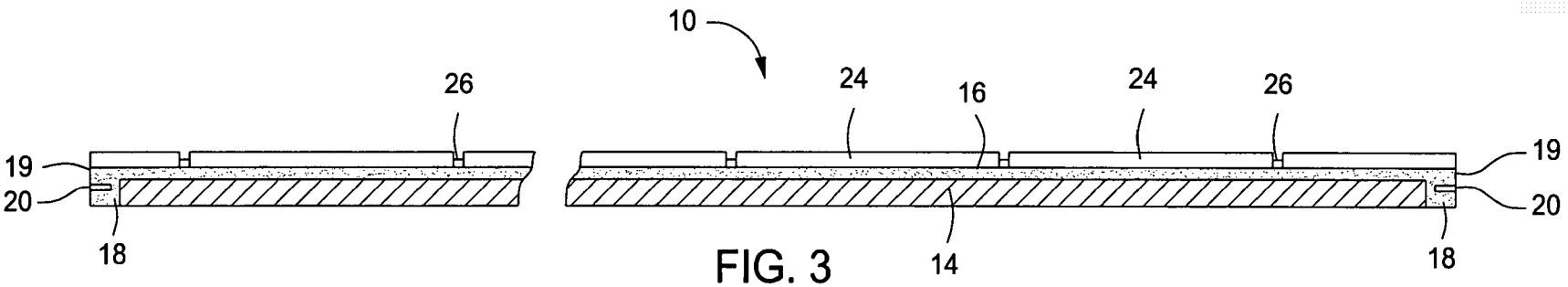
FIG. 3 is a horizontal sectional view taken along line 3-3 of FIG. 1.

The panels 10 of FIGS. 1-3 are depicted as composite panels having a wood or masonry sheathing or backing panel 14, that is embedded within or in fixed assembly with a moisture resistant panel substrate 16 composed of polyurethane, polyurethane foam or other similar single or multi-component polymeric materials that form a moisture barrier. Embodied panels can thereby have flexibility similar to that of plywood or similar materials, such that a wall or other surface of a building structure, formed by the panels, can flex or move slightly in response to naturally occurring forces without fracturing or cracking any portion of the panels, which is a common shortcoming of conventional structural materials. The substrate material 16 is depicted having a rectangular configuration and defines a rectangular surround structure 18, having edges 19 that define the top, bottom and sides of the depicted panel. The depicted panel can be provided in 48"×96" or 48"×32⅝" sizes, to facilitate fitting within the on-center stud spacing of a conventional building framework. However, the panels may be of larger or smaller dimension depending on the size and/or orientation of the panels, the purpose of the panel and the structure with which the panels are to be used, and/or on the preferences of the designer, contractor, and/or other personnel.

Figure 4:
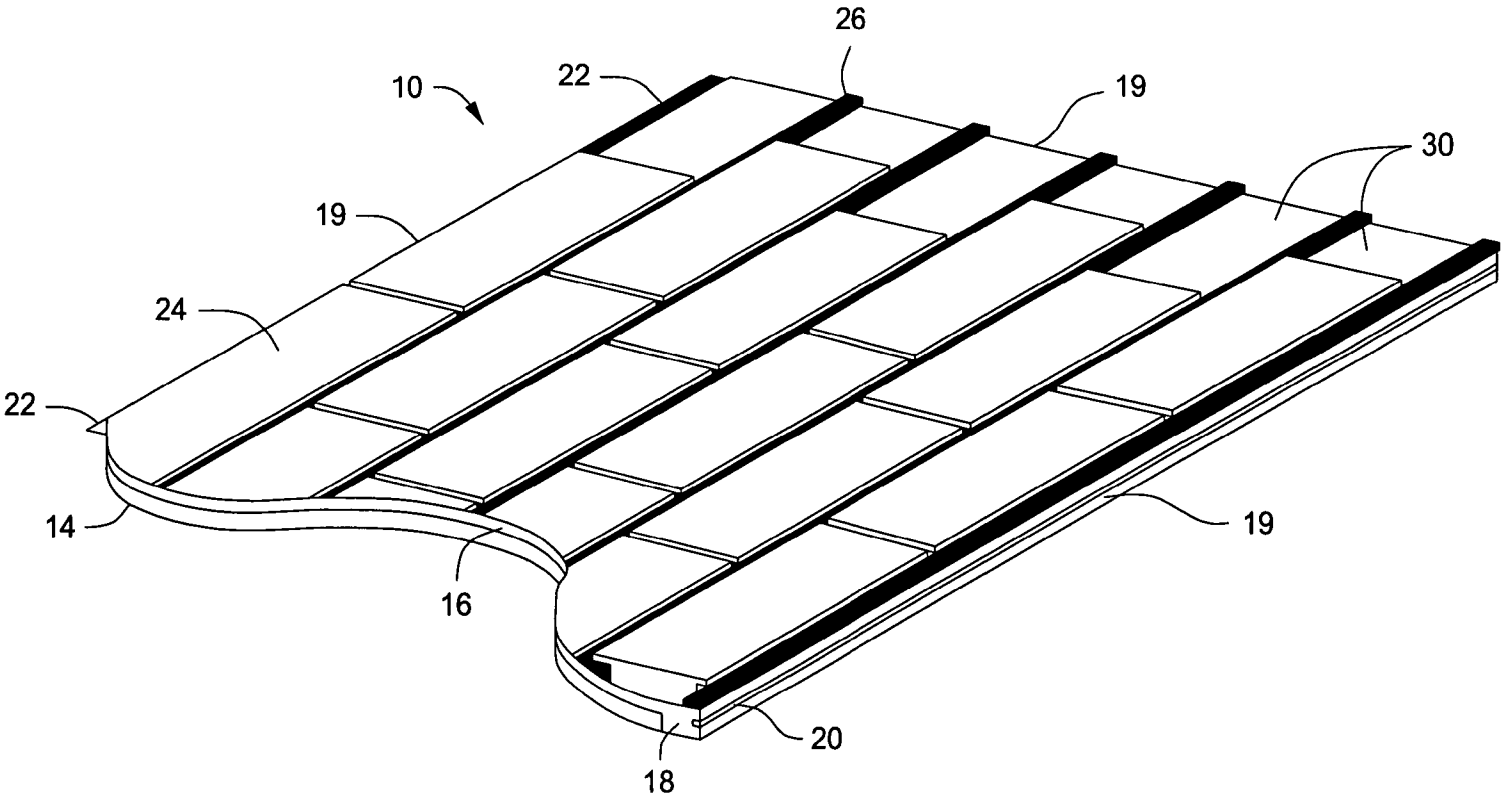
FIG. 4 is an isometric view of illustration showing a portion of an embodiment of a panel usable within the scope of the present disclosure.

As shown in FIG. 2, the surround structure 18 can include spline openings, channels or receptacles 20, within which spline members 22 can be received to facilitate edge to edge alignment of adjacent panels. In an embodiment, one side of each panel can include a spline slot or channel, while the opposing side of an adjacent panel can include a spline member projecting therefrom for insertion into the channel, to ensure that the edges 19 of adjacent panels are properly aligned. Proper alignment of panels can ensure the proper appearance of an external façade, e.g., panels having thin brick, stone, and/or masonry members having the appearance of a wall. However, in other embodiments, each of the surround portions of a panel structure can include spline slots, while spline members can be positioned within adjacent spline slots after construction of the panels (e.g., during installation in the field). In addition to maintaining each of the top, bottom and side edges of adjacent panels in alignment, the splines also assist in providing a weather-tight closure of joints between the edges of adjacent panels to minimize the potential for ingress of water and/or air. In an embodiment, closure and/or sealing between panels can be enhanced by application of interlocking flashing strips 29 (shown in FIG. 1), which can include strips of metal, polymer or any other suitable flashing material, positioned over the joints between edges of adjacent panels. While FIG. 1 depicts only a single flashing strip 29 for illustrative purposes, it should be understood that any number of panel joints 28 can be covered by flashing to improve water resistance of a resulting wall. To facilitate installation of the flashing strips, the lateral grout lines of each panel can be limited in length, such that they do not extend completely to the side edges of the panels, as shown in FIG. 4. Alternatively or additionally, the ends of the grout lines can be removed to provide flat edge surfaces for mounting of the flashing. The flashing strips 29 may be secured in place by screws, nails, rivets, or any other type of retainer member, fastener, and/or bonding material or adhesive. Sealing of the panel joints 28 can further be enhanced by application of a moisture impervious layer of silicon caulking or other sealing material. The flashing strips 29 may be applied over the joint caulking material if desired. The moisture impervious layer will subsequently cure to a durable form. In an embodiment, the closure strips and joint sealant can be covered by finish elements such that the closure strips and sealant are not visible in a completed structure.

A plurality of finish elements 24, which are depicted as masonry or masonry-like façade elements in FIGS. 1 and 4, are shown placed in a desired pattern on each panel. Finish elements 24 can be placed in the desired pattern within a mold, and a dry pulverulent grout/particulate material 26 can be placed and/or compacted within grout spaces between the finish elements. The finish elements 24 can include a wide variety of surface materials, such as ceramic tiles, natural or artificial stones, or other surfaces suitable for use with interior or exterior walls, flooring, ceilings, counters, backsplashes, and roofs. In an embodiment, the finish elements 24 can include a porous material, defining minute interstices into which uncured liquid polymeric material can penetrate during the manufacturing process to facilitate retention of the finish elements within the body of the panel. The pulverulent/particulate material 26 is shown within the gaps or spaces between the top, bottom and side edges of adjacent finish elements, and can be compacted within the spaces prior to application of the substrate. In an embodiment, the particulate material can be located only in the spaces between the finish elements, and is not placed beneath the finish elements to secure the finish elements to the panel structure. The polymeric/substrate component of the composite panel assembly serves to affix the finish elements to the panel, such that the pulverulent/particulate material is not required to function as conventional grout or mortar. Even distribution and compaction of the grout material within the grout spaces can be accomplished by subjecting the grout to mechanical pressure, such as by use of a press mechanism (e.g., a resilient pad of open cell polymeric foam or similar resilient material attached to a press plate, which can be deformed into the grout spaces by the force of the press). The particulate material can include a binder composition mixed therein, such that arranged/compacted material will retain its compacted/arranged state during the panel manufacturing process.

The finish elements and particulate/pulverulent material can be secured to the panel structure 16 by the adhesion that occurs as an uncured liquid polymeric foam mixture or similar suitable substrate is sprayed, poured, and/or otherwise placed in association with the back surfaces of the finish elements, after positioning the finish elements in a desired arrangement within a mold. The polymer or polymeric foam substrate serves to fix the finish elements to the panel structure. During manufacture, the substrate can be confined within a mold in its uncured state, and subjected to the mechanical pressure (e.g., via a press), causing the polymeric foam to assume the configuration of an integral polymeric substrate covering substantially the entire rear surface of the panel, thereby forming a moisture resistant and thermal insulating layer. The mold can be shaped to cause the polymeric foam substrate to define a surround or border structure of the panel (e.g. by permitting the substrate to flow around the edges of other panel components prior to curing). In an embodiment, the border can have a rectangular shape, but it should be understood that any shape and/or dimension can be achieved depending on the configuration of the mold. In an alternative embodiment, one or more finish elements can be secured to the substrate using a bonding agent (e.g., cement, adhesive) or any other means for mechanical retention. FIG. 1 depicts a plurality of "missing brick" and/or "leave-out" spaces 30, located at the edges of adjacent panels, where such alternative methods can be used to apply finish elements to the panel.

As described above, FIGS. 1-3 depict the finish elements 24 as thin brick or brick-like masonry members, such that a finished wall formed from the depicted panels will have the appearance and serviceability of a conventional brick and mortar wall. It should be understood, however, that the finish elements 24 can include any type of surface, including generally thin and/or flat natural or artificial stones, or any other type of desired surface (granite, tile, wood, laminate, etc.). Materials other than masonry or stone members may also be used to form the exterior finish or facade of the pre-manufactured construction panels so that the resulting wall structure may have any desired appearance. When stones or similar irregularly-shaped elements are used, the elements can be positioned to accommodate a repeating facade pattern. Such an arrangement can permit the finish elements to be retained in a jig having the desired pattern during panel manufacture. In an embodiment, jigs and/or finish elements can be designed to result in uneven positioning of the face surfaces of the finish elements, such as when it is desired to provide a wall having uneven surfaces to mimic a conventional stone wall.

As noted above and shown in FIGS. 1 and 4, abutting side edges 19 of adjacent panels fit together to form edge joints 28. The pattern of the finish elements 24 along the sides of the panels is shown terminating prior to the edge of each panel (e.g., in a spaced and/or set back relation from the side edges) to define "missing brick" spaces 30. It should be noted that sites for receiving finish elements located at the edges of adjacent panels can bridge/extend across the edge joints 28. For example, FIG. 1 shows the grout lines above and below the missing brick spaces extending to the side edges of the panel to define a space where a "missing" finish element can be added. In the case of rectangular masonry elements, such as thin bricks, the filler bricks can be secured across two abutting panels, such that the joint between the panels is not apparent. The size and arrangement of the finish elements 24 and missing brick spaces 30 can be selected such that one or multiple finish elements can be placed in the spaces 30, or a filler assembly/material can be applied.

With reference to FIG. 4, an embodiment of a panel 10 usable within the scope of the present disclosure is shown in greater detail, in a substantially horizontal position, suitable for manufacture (as described below in connection with FIGS. 8 and 9. As described above, a sheathing or backing panel 14, which can be composed of wood, masonry, OSB, polymer or any other generally durable material usable as sheathing material, forms an interior surface portion of the panel structure. A moisture impervious or resistant multi-function polymeric substrate 16, which can be composed of polyurethane, polyurethane foam or any one of a number of other suitable single or multi-component polymeric materials, is integrated with the sheathing or backing panel 14, and in the depicted embodiment, provides a generally rectangular surround structure 18 that is integral therewith and encompasses the edges 25 of the sheathing panel 14. The surround structure 18 is shown having a rectangular configuration (e.g., 4'×8'), defining substantially straight edges 19 at the top and bottom sides of the panel. The polymeric substrate 16 can provide the panels with moisture resistance and thermal insulation characteristics, and can materially enhance the structural integrity of the panels. Independent of the shape, configuration, and dimensions depicted in FIG. 4, it should be understood that embodied panels may be of any size, shape, and configuration able to be secured to an underlying building structure (e.g. framework members), and/or that is able to accommodate desired finish elements. On one or both of the sides of the panel structure, and on the upper or lower edge, the surround structure 18 can include spline slots or channels 22 for receiving spline members 22, able to be received in channels of adjacent panels to facilitate alignment. The spline members 22 can enhance the structural integrity of assembled panels and facilitate closure of a joint 28 between adjacent panels to reduce water and/or air ingress.

As shown, for example, in FIG. 2, the finish elements 24 can be placed in a desired relationship, (e.g. a spaced relationship), and at least partially embedded within and/or fixed to the polymeric substrate 16. The finish elements 24 can be separated by grout lines 26 to provide, e.g., the appearance and function of a conventional brick or brick veneer wall structure. At each end of the panel structure, empty spaces 30, as shown in FIGS. 1 and 4, are defined, so that side edges 19 of the panels can be straight, independent of the dimensions and/or type of finish elements used; however, it should be understood that such spaces may not be necessary in embodiments where finish elements can be arranged in a configuration where one or more elements would not extend beyond the edges of a panel, and/or when types of finish elements able to be shaped, cut, and/or omitted, without hindering the overall function or appearance of the panel are used. After the panels have been secured to the framework members 12, e.g. of a wall structure, such as by screws or any other suitable fasteners, adhesives, bonding agents, etc., any empty spaces 30 can be filled with additional finish elements and/or by a filler assembly, e.g., to bridge adjacent panel joints 28. Any number of additional panels can be secured to a wall/surface structure to expand the structure in a vertical or horizontal/lateral direction. Particulate and/or spacing material can be sprayed or otherwise applied in the spaces between the finish elements to both provide a desired spacing and appearance, and to cover any damage that could be caused by screws and/or other fasteners that are applied to secure the panels. In an embodiment, any manner of adhesive material can be used to attach finish elements or other materials to the empty spaces 30, while silicon and/or other suitable caulking materials (e.g. a two-component epoxy) can be applied in the grout space adjacent each empty space. Silicon and/or caulking materials can also function as a surface adhesive to bond particulate material between the finish elements, and to bond finish elements placed in the empty spaces 30. The caulking material can also assist the sealing capability of the splines at the edges of the panels. While the silicon or other caulking material is in its uncured state, particulate materials can be applied to the spaces between finish elements, where it can become embedded in and/or adhered to the caulking material. As such, the depicted panels can be provided with the appearance of a conventional masonry wall structure, while the joints 28 between adjacent panels are not visible in a completed construction. Installation of conventional brick façade materials requires a cleaning step to remove brick and mortar dust from the exterior show surface of the brick façade, e.g., using an acid solution. Embodiments of the present panels do not require subsequent cleaning, further conserving time and expense when compared to conventional materials and methods. In other embodiments, finish elements can extend beyond the edge of one panel, for receipt in an adjacent empty space of an adjacent panel, rather than installing such finish elements in the field.

In one possible embodiment, finish elements can be formed from exceptionally lightweight materials. For example, magnesium oxide materials, such as those available from Jet Products, LLC, are typically available in the form of 0.5"×4 8"×96" or 0.25"×24"×48" boards. Such boards are typically brittle when used in such large sizes, and as such, are available with fiberglass reinforcement materials. However, smaller panels of magnesium oxide, e.g., 2.625"×7.625" rectangles, sized similarly to brick veneer elements, do not suffer from the same drawbacks and are as durable, if not more so, than conventional brick and/or masonry veneer materials and façade elements. Magnesium oxide materials are significantly lighter than other masonry façade materials, and can be much thinner than other masonry counterparts, reducing the time, weight, and expense required to construct a panel using such elements.

It is noted that magnesium oxide materials are normally extremely smooth, and white in color, and as such, would normally be unsuitable for use as aesthetic substitutes for brick veneer. However, in an embodiment, finish elements of magnesium oxide can be ground on at least one surface thereof to provide a surface texture that mimics the texture of a natural clay brick, dipped into an exterior-grade concrete stain, then dipped into a composition that includes Portland cement, magnesium cement, clay dust, and a light aggregate (e.g., sand). While normal methods of coloration are typically not effective for staining, coloring, and/or changing the appearance of magnesium oxide materials, a composition including such components can provide magnesium oxide finish elements having at ground/textured surface with a color similar to that of natural brick.

Magnesium oxide materials can also be used as backing/sheathing layers in embodiments of the present panel. For example, a magnesium oxide panel (e.g., a 0.25"×24"×48" board thereof) can have an adhesive compound applied to its surface, while finish elements (such 2.625"×7.625" as magnesium oxide elements, as described above) can be bonded thereto with a gap (e.g., 0.375 inches) between the elements to simulate the appearance of a brick wall. A particulate mixture can be applied to the spaces between the finish elements to complete the appearance of the wall. As the adhesive cures, it can adhere the finish elements and particulate material to the backing panel. Finish elements at the edges of the panel can be allowed to extend past the edge thereof (e.g. 0.125 inches beyond the edge) to facilitate alignment with adjacent panels and to cover the gap between adjacent panels.

A completed panel of such construction has the appearance and feel of a typical masonry brick wall, but does not require the structural support normally associated with brick installation. Such panels are also lightweight, fire resistant, and sound absorbing (acoustically soft.) The panel can be applied directly to open framing studs, an existing drywall or wood surface, metal panels, or any other framework member, such as through use of drywall or deck screws, contact or wallboard adhesives, or other mechanical and/or adhesive means. While the panel is described in the context for use in an exterior brick wall of a structure, it should be noted that such panels can be used with interior walls, floors, ceilings, roofs, counters, backsplashes, and any other structural surface.

Figure 5:
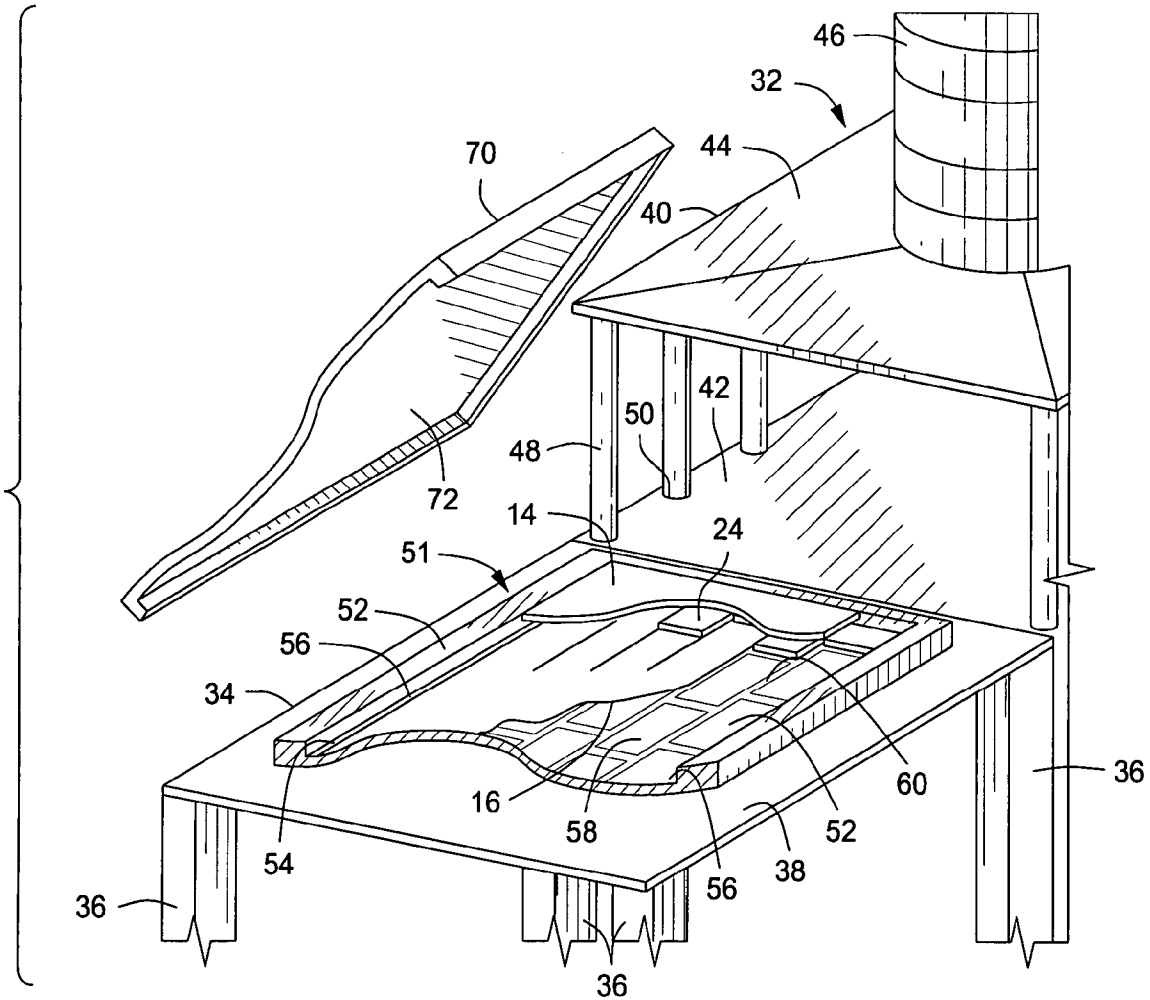
FIG. 5 is an exploded isometric view illustrating one possible method of manufacture for a panel using a machine.

Referring now to FIG. 5, an isometric view illustrating one embodiment of manufacturing panels usable within the scope of the present disclosure is shown. A manufacturing machine 32 having a production table 34, supported and stabilized by legs 36, defines a table top 38 that serves as a substantially flat and horizontally oriented mold support member. The manufacturing machine 32 also includes a press device 40 having a press support plate member 42 and a moveable platen 44. The moveable platen can be driven by a motorized actuator 46, such as a hydraulically energized ram or an electrically driven actuator member, or any other suitable mechanism for driving the moveable platen 44 downward to apply a desired mechanical force to a mold 51, that is situated on the press support plate member 42. One or more guide bars 48 or similar members, extending through guide openings 50 in the edges of the press support plate member 42, can be used to guide the platen 44.

Figure 6:
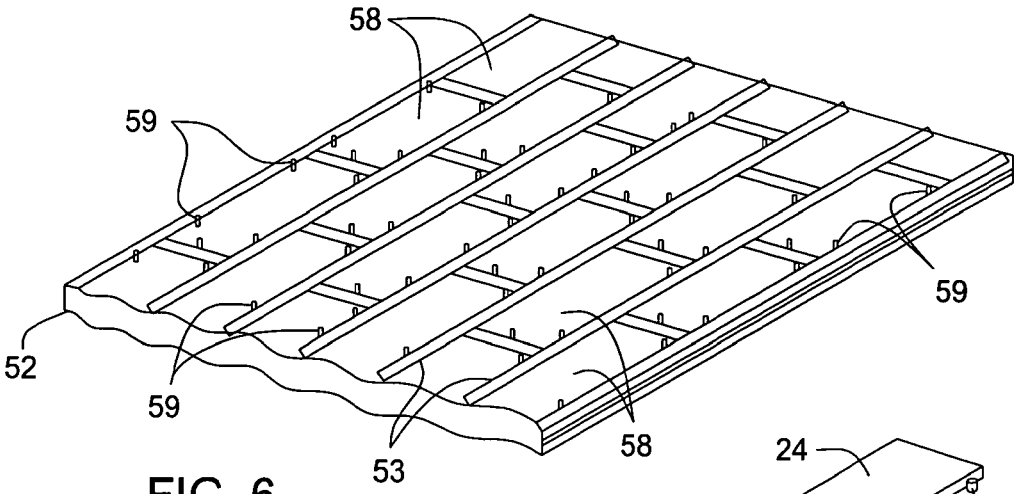
FIG. 6 is an isometric illustration showing a part of a masonry element alignment jig having alignment pins usable with an embodiment of a method for manufacturing panels.
Figure 6A:
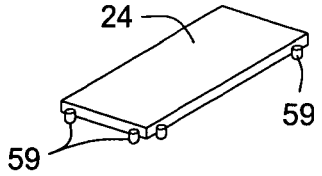
FIG. 6A is an isometric illustration showing an association of the alignment pins of FIG. 6 with a finish element.

The manufacturing process can begin by placing a mold base 52, shown as a generally rectangular member, on the production table 34. The depicted mold base 52 defines a rectangular mold pocket, recess or receptacle 54 therein having a bottom receptacle wall 56. The mold base 52 can be composed of wood, metal or any of a number of suitable polymer materials and/or composite materials. If desired, a mold composed of a suitable material, such as silicon, may be placed within the mold recess 54 to provide location devices or geometry for precise location of finish elements within the mold. In an embodiment, a finish element alignment jig 53, shown in FIGS. 6 and 6A, can be placed in the mold recess or receptacle 54, the jig defining multiple finish element sites 58 within the recess. Each of the depicted finish element sites 58 can include spacers or similar means for facilitating precise location and alignment of the finish elements. Suitable means for finish element location, with respect to the bottom wall 56, can include locator pins 59 that extend upward from the jig 53, generally to a height less than the thickness of the finish elements. In the embodiment shown in FIGS. 6 and 6A, each of the finish element sites 58 is defined by eight locator pins 59, two of which are positioned in aligning relation with each of the four corners of a finish element 24, as shown in FIG. 6A. The locator pins 59 can position the finish elements 24 in accurately spaced relation with one another to define grout spaces therebetween and prevent the finish elements from shifting laterally during the panel manufacturing process. This feature permits each finished composite construction panel to have the resulting appearance of, for example, a portion of a brick and mortar wall, with the even spaces between the finish elements serving to provide the appearance of the conventional mortar joints.

When finish elements having irregular (e.g. non-rectangular) shapes are used, such as when attempting to replicate the appearance of a stone wall, the alignment members or pins of a specifically designed stone positioning jig can be located according to a repeating pattern utilizing specific shapes and dimensions of each element. The finish elements, can be placed "outer or front surface down" within the element sites 58 defined by the locator elements or pins 59 of the alignment jig 53, thus positioning the thin finish elements 24 in properly oriented and spaced relation with one another, independent of the specific dimensions of each finish element. The uneven face surface positioning of irregular elements, such as the stones of a stone wall, can be replicated by the construction of the special jig or by the use of support and/or positioning members within the mold or jig, or combinations of these approaches.

Figure 6B:
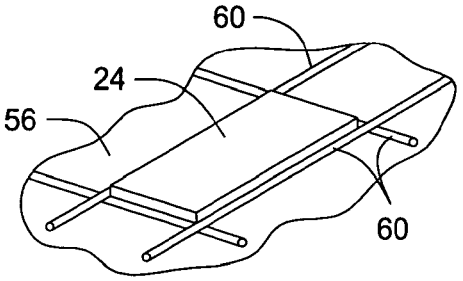
FIG. 6B is a partial isometric illustration of an alignment jig having ridges usable with an embodiment of a method for manufacturing panels.

In the alternative or in addition, location of the finish elements may be achieved by providing alignment ridges 60 on the bottom wall 56 of the mold base 52, as shown in FIG. 6B, or by providing location geometry in a mold composed of silicon or another suitable flexible mold material. The alignment ridges 60 permit secure and accurate positioning of each of the finish elements 24, enabling accurate spacing therebetween. The alignment ridges 60 can also prevent lateral shifting of the elements during the panel manufacturing process. Other means for accurately locating finish elements with respect to a mold base can also be provided within the spirit and scope of the present disclosure.

Figure 7:
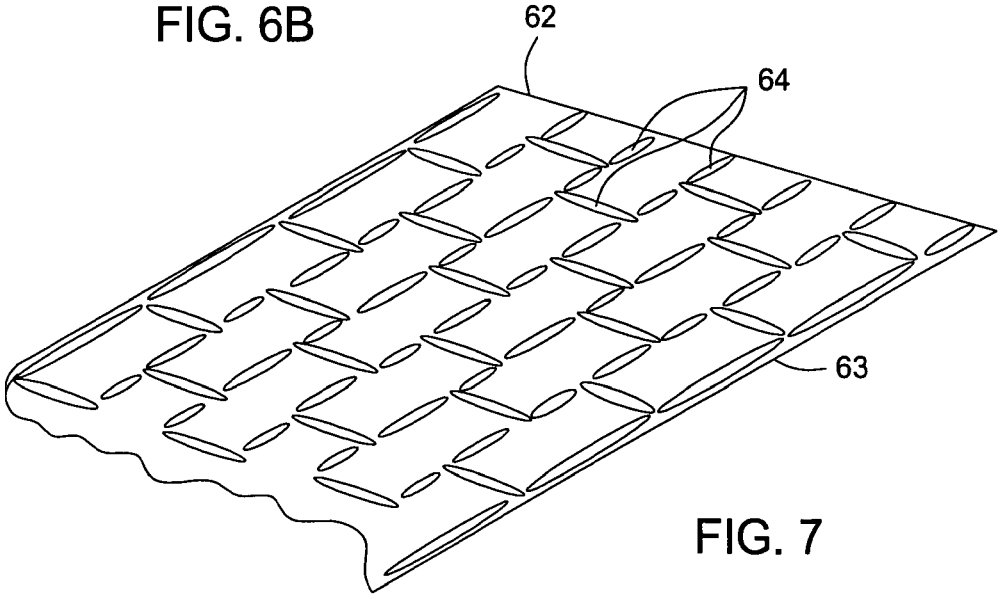
FIG. 7 is an isometric illustration of a screed member having grout holes or slots usable with an embodiment of a method for manufacturing panels.
Figure 7A:
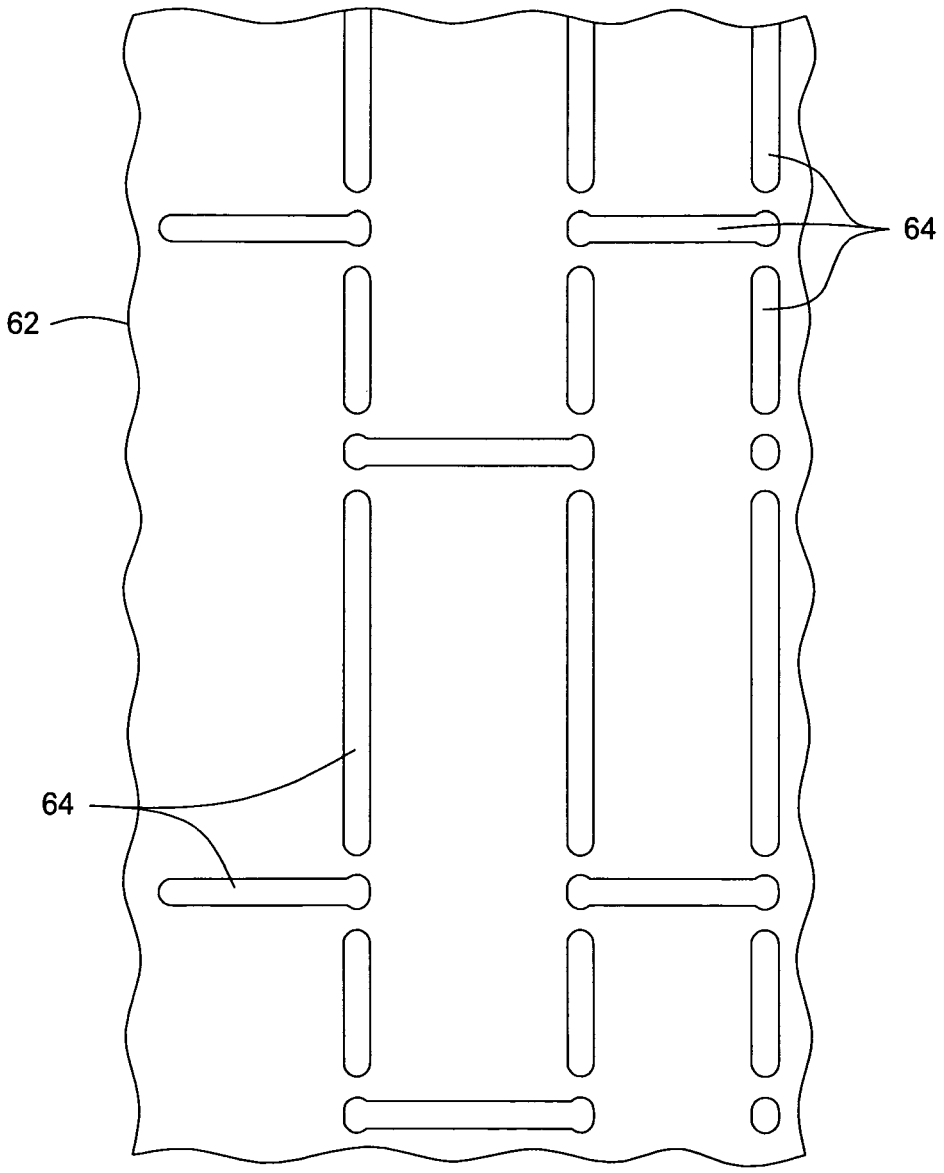
FIG. 7A is a partial plan view showing a portion of the screed member of FIG. 7.

FIG. 7 depicts a generally screed panel member 62, having a generally rectangular shape, while FIG. 7A depicts a detailed view of a portion thereof. In use, the screed panel member 62 can be removably placed within the mold base 52, above the arranged finish elements 24. The screed panel member 62 defines a planar bottom surface 63 for engagement with the inner or back faces of the finish elements, and is shown having a plurality of slots 64 (e.g., holes for depositing particulate material therethrough) that are positioned in alignment with the grooves or spaces that are defined between adjacent finish elements, which are supported by the jig 53 (shown in FIG. 6). The screed 64 can be aligned with the spaces between the finish elements 24 using, for example, alignment pins projecting from the mold to engage corresponding alignment holes in the screed panel. During panel manufacture, the machine 32 can be configured to precisely position the screed panel with respect to the mold. As such, the configuration of the slots 64 is such that dry pulverulent or particulate material can be readily deposited into the spaces between finish elements while the body of the screed prevents the passage of such material to other parts of the mold and/or panel. The shapes of the slots 64 can determine the amount and specific location of the particulate material. In an embodiment, the pulverulent/particulate material can include a binder composition that enables the material to be compacted to an essentially solid, porous form, and to maintain its compacted form as successive panel manufacturing process steps occur. The planar surface 63 of the screed panel member 62 can engage and/or cover the surfaces of the finish elements to ensure that the back surfaces thereof remain free of the particulate material deposited through the slots 64. In an embodiment, deposition of particulate material can be accomplished simply by applying the particulate material to the upper surface of the screed member 62, then sweeping or wiping the material through the slots 64, so that an essentially measured quantity of particulate material falls into the spaces between finish elements. Alternatively, an application system may be provided for directly depositing material into the slots 64, so that very little particulate, if any, is permitted to contact the upper surface of the screed panel member or the back surfaces of the finish elements.

After the grout deposit operation has been completed, the screed member 62 can be removed from the mold so that loose dry pulverulent or particulate material is present and substantially evenly distributed within the spaces 62 between the finish elements 24. As stated above, since portions of the screed member 62 cover the back faces of the finish elements 24 during the deposit process, the back faces can remain substantially free of particulate.

Figure 8:
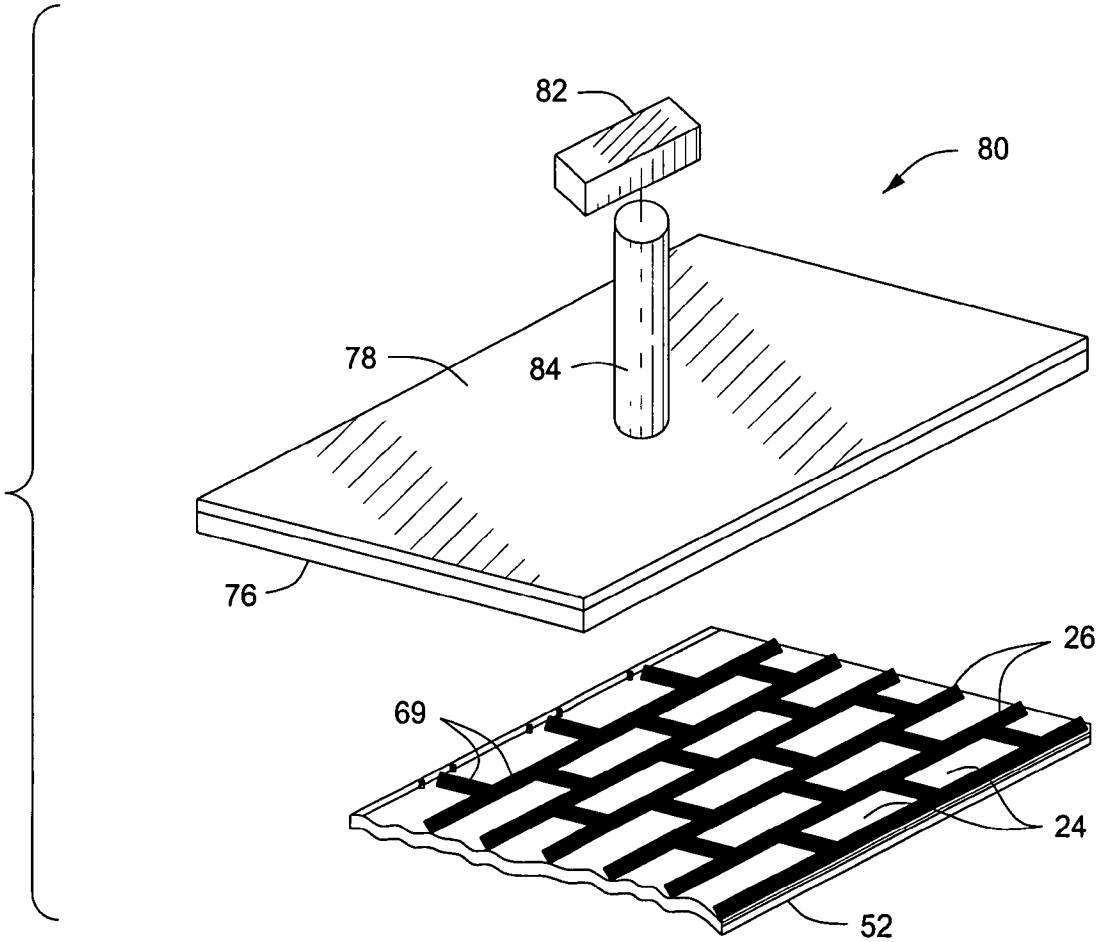
FIG. 8 is an exploded isometric illustration showing an open-cell polymer foam sponge panel with a rigid backing positioned above a masonry element alignment jig, usable with an embodiment of a method for manufacturing panels.

With reference to FIG. 8, when it is desirable to subject the loose particulate material to a desired compaction within the spaces between the finish elements, to facilitate even distribution and proper placement thereof, a compressive force application mechanism 80 can be used. Compaction prepares the particulate material to receive an uncured or substantially liquid polymeric material, such as mixed but uncured urethane foam, so that the liquid polymeric material applied in a subsequent step penetrates to a desired depth within the material, but does not penetrate completely therethrough. As such, a layer of the particulate material can be bonded or otherwise secured to the polymeric substrate, such that the material becomes substantially permanently fixed within the spaces between finish elements. By ensuring that the polymeric material does not fully penetrate the particulate material, the polymeric material does not become exposed to view within the spaces, which could potentially detract from the desired ornamental appearance of the finished panel.

The depicted force application mechanism 80 includes an actuator and actuator control system 82, such as a pneumatic or hydraulic actuator, having a vertically moveable actuator member 84 to which a stiff rectangular backing panel member 78 is secured. A rectangular panel 76 including a soft and/or deformable material, such as an open cell foam material, is shown secured to the lower surface of the backing panel member 78, thereby providing a soft body of material that can engage the back surfaces of the finish elements and be deformed into the spaces 69 when compressive force is applied to the stiff backing member 78. While FIG. 8 shows rectangular components, it should be understood that a compressive force mechanism having any desired shape and/or dimensions could be used to compress all or a portion of the assembled panel elements. Additionally, while FIG. 8 depicts a mechanism oriented to apply force in a downward/vertical direction, other orientations of panel elements and mechanisms could be used without departing from the scope of the present disclosure. When the actuator mechanism 82 is energized to provide force (e.g. in a downward direction), the actuator member 84 will drive the backing member and panel 76 into contact with the back surfaces of the finish elements 24. Further movement of the backing member 78 and panel 76 can conform the material of the panel to the configurations of the finish elements 24, such that the material of the panel 76 enters the spaces 69 between finish elements. Portions of the material that contact the particulate matter within the spaces 69, previously deposited loosely through the slots of the screed member, as described above, can cause even distribution and compaction of the particulate material. As the particulate material is compacted, a binder composition, mixed therewith, can cause the particulate material to be compacted into a substantially rigid, porous form, such that the particulate material remains in place within the spaces 69 throughout the panel manufacturing process. The porous nature of the compacted particulate material defines interstices into which uncured polymeric foam material can migrate as the mold and panel assembly is later subjected to the mechanical pressure of a press. The compacted nature of the particulate material, the consistency and applied volume of the liquid polymeric substrate material, and the pressure that is applied by the press, can be selected to ensure that the polymeric material does not penetrate completely through the grout material to the front surface thereof, where it would be visible. The cured polymeric material can provide support for the particulate material within the spaces 69, while further providing the material with the appearance of a conventional mortar joint for a brick or other masonry wall, or any other desired appearance. It should be noted that FIG. 8 represents a manufacturing step that can be a part of an automated panel manufacturing system, whereby two or more construction panels may be actively engaged in the manufacturing process at any point in time. This feature is discussed in greater detail below in conjunction with multiple manufacturing illustrated in FIG. 10.

After completion of the grout compaction operation, the actuator mechanism 82 can be energized to move the backing member 78 and panel 76 away from the assembled panel elements (e.g. upwardly and/or laterally). The mold base or jig 52, with finish elements 24 and compacted particulate material 26 can be subjected to subsequent manufacturing steps, as illustrated in FIGS. 9 and 10. Subsequent steps can be performed with the mold base 52 remaining stationary, or the mold base can be moved to subsequent locations (e.g., manufacturing stations), such as described below with reference to FIG. 10.

Figure 9:
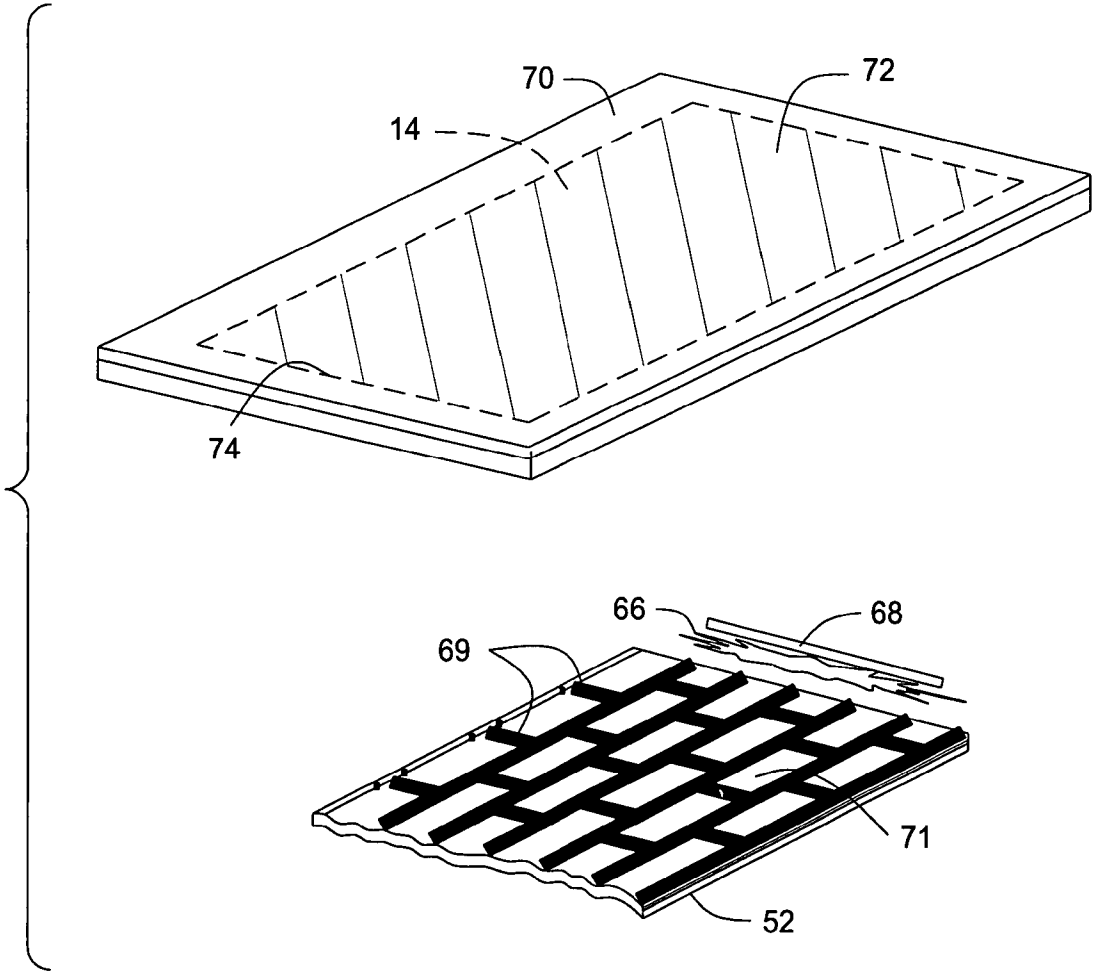
FIG. 9 is an exploded isometric illustration showing a masonry element alignment jig and a foam substrate applicator for mixing and applying a substrate of polymer foam binding material to the jig, usable with an embodiment of a method for manufacturing panels.
Figure 10:
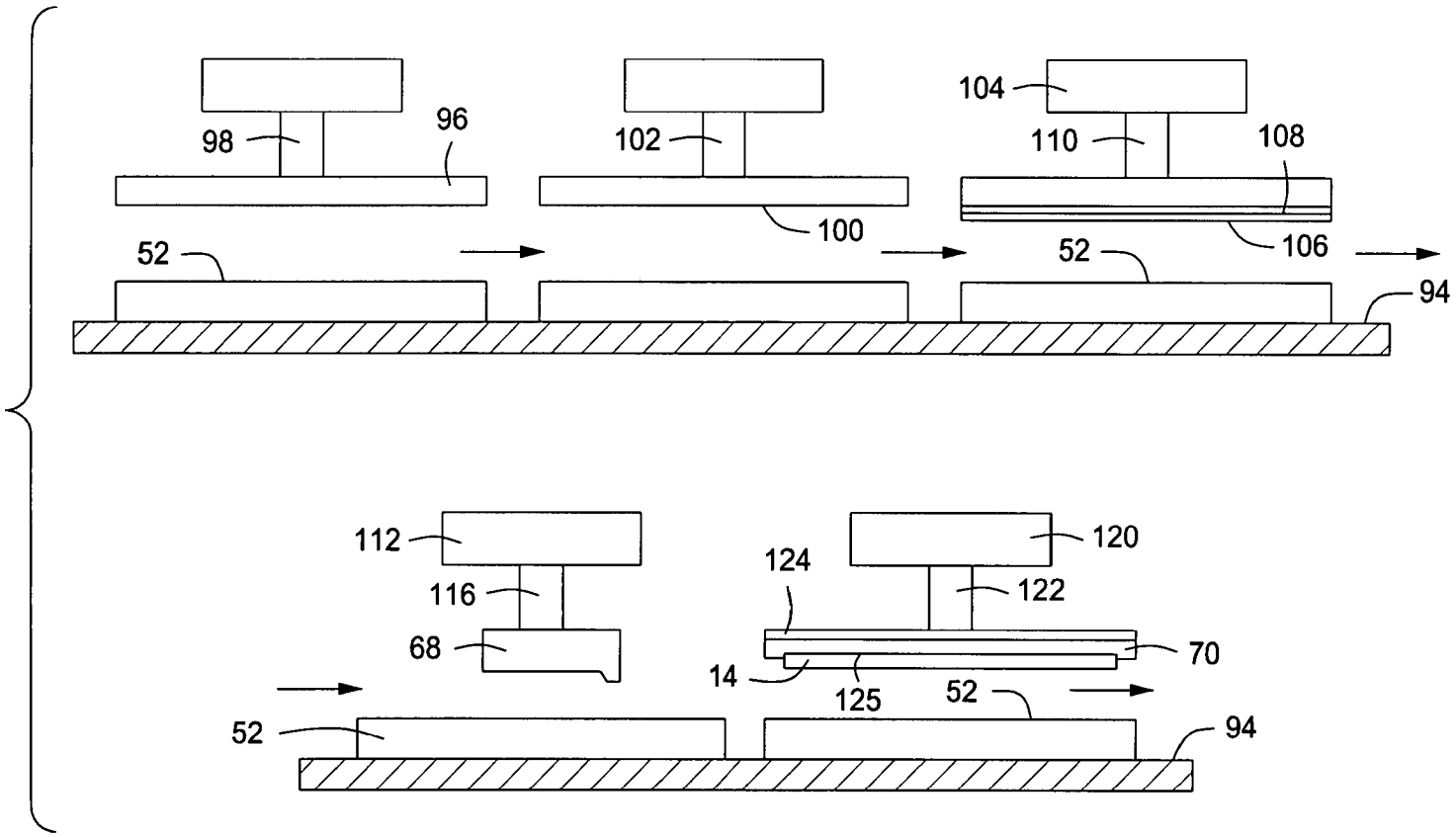
FIG. 10 is a schematic illustration showing one possible embodiment of an automated manufacturing process and system usable to manufacture a panel usable within the scope of the present disclosure.

FIG. 9 depicts a polymer foam applicator 68, associated with a polymer foam mixing and supply system 66, which is usable to apply a contiguous substrate layer to the back face 71 of the assembled panel components. For example, the polymer foam applicator 68 can be moved relative to the back face 71 of the panel elements, and/or the mold base or jig containing the panel elements can be moved relative to the applicator 68. The polymeric foam substrate 16 can provide the resulting panel with mechanical structure, a thermal insulating quality, and can also serve to provide a moisture and air barrier to minimize the potential for passage and/or wicking of water and/or air through the panel. While the use of a two component polymeric material, such as polyurethane foam material, is specifically referenced, it should be understood that this is one illustrative example of a usable substrate material, and that any polymeric or other type of material having similar qualities can be used, including, without limitation, any material that can set and/or cure, such as polyurea, or light- or thermally-activated, or chemically-catalyzed polymers.

Returning to FIG. 5, after the polyermic substrate 16 has been applied, an upper jig or mold lid 70 can then be brought into association with the lower jig or mold base 52. A sheathing or backing panel 14, as shown in FIGS. 2-5, can be placed behind the substrate layer to add material stiffness and structural integrity to the finished panel 10. The backing panel 14 can be sufficiently flexible to provide the finished panel with flexibility during installation, prolonged usable life, and resistance to stress and cracking. In one embodiment, the backing panel 14 can be composed of oriented strand board "OSB", a cement-containing panel or sheet, a polymer or polymeric composite, plywood, or any of a number of other suitable rectangular panel sheet materials. In other embodiments, the sheathing or backing panel 14 can include magnesium oxide, as described above. In an embodiment, the backing panel 14 can have a porous surface and/or a surface containing microscopic irregularities for facilitating bonding between the panel 14 and the polymeric foam substrate. When wood or a similar material is utilized to form a sheathing or backing panel, the material may treated to enhance the water-resistant character thereof and resist the tendency of various wood or board materials to become warped by excess moisture. In an embodiment, only the exterior or facade surfaces of the finished panel could be water resistant, while use of untreated wood or other similar materials as the backing substrate, that faces the interior of a structure, may be unlikely to cause damage due to the minimized potential for ingress of moisture through the exterior of the completed panel.

During panel manufacture, as shown in the exploded isometric illustration of FIG. 9, the sheathing panel 14 can be positioned within a recess or pocket 72 within the upper jig lid 70, indicated by broken lines at 74. As the upper jig lid 70 is positioned in association with the jig or mold base 52, the sheathing substrate 14 can thereby contact the uncured polymeric foam material that has been deposited on the back face of finish elements and particulate material. Association of the upper jig lid 70 with the mold base 52 can thereby accurately position the backing panel substrate 14 with the remainder of the panel elements, allowing the polymeric substrate to bond with the packing panel in a manner that will avoid de-lamination over time.

Once the upper jig lid 70 is lowered into association with the mold base 52, the jig, mold, and/or upper jig lid can be subjected to mechanical compression, such as by means of a press, for a sufficient period of time for the sheathing substrate 14 to become bonded to the polymeric substrate, for pressure induced penetration of the polymer into the particulate material, and for any small spaces that might exist within the mold to be filled with the polymeric material. In embodiments where polymer foam is used, expansion thereof will tend to fill the mold and generate internal pressure that enhances the density of the cured polymeric foam. Additionally, the mechanical compression, together with the configuration of the mold base, can prevent deformation of the panel during curing of the polymeric material. Pressure-induced compression of the polymeric foam material during the manufacturing process can cause the polymeric foam material to produce the desired density to enhance the moisture proofing and structural integrity of the completed panels. The pressure can also enhance the bond established between the substrates and components. When the mechanical compression is released, the completed panel can naturally maintain its flat configuration. Thus, when the construction panel is subsequently installed. e.g., to vertical components of a building framework, such as wall studs, or other generally straight and/or flat surface structures, there will be no need to apply force using fasteners to conform the construction panel to the surface structure.

As described above, in its compacted state, the pulverulent/particulate material 26 can include minute interstices between grains or particles. These interstices permit pressure-induced penetration of the uncured polyermic material, to a desired depth, at least partially due to the compression that is applied to the jig or mold base 52 and/or the mold lid or cover 70. The pocket or receptacle 72 within the mold cover, which includes the sheathing panel substrate 14 at position 74, is thereby bound to the particulate material 26 and finish elements 24 by the curing of the polymeric material. The sheathing substrate panel 14 is thereby released from the pocket or receptacle 72 upon release of the mold cover 70 from the mold base 52. The depth to which the uncured liquid polymer penetrates into the interstices of the compacted particulate material can be controlled by application of limited or controlled volume and/or mechanical pressure.

Thus, after the compaction operation, the polymer applicator mechanism 68 can be activated to mix polymeric materials and distribute uncured polymer on the back portion 71 of the panel elements. Sufficient material can be deposited into the mold to form the surround structure 18 of the resulting panel. Compressive force then causes the polymeric material to enter the interstices between grains of particulate material, to bind the material in place and further distribute the material within spaces between the finish elements. Curing of the polymeric material fixes the finish elements and particulate material in place, and binds these elements to the sheathing panel.

Embodiments usable within the scope of the present disclosure can be at least partially automated, thereby enabling enhanced volume of manufacture. For example, multiple conveying devices for simultaneous operation of any and/or all steps in the panel manufacturing process can be employed such that numerous panels may be simultaneously produced and/or can undergo various stages of production at the same time. One suitable system for automated manufacture is shown schematically in FIG. 10, where mold bases 52 and/or other panel support and movement devices can traverse an assembly line in a direction from left to right, as shown by movement arrows, along a mold conveyor 94 or similar transport means. In an embodiment, the mold conveyor can include a conveyor belt, a chain driven member, or any other type of device able to cause incremental movement of a plurality of mold bases, and for positioning the mold bases at various locations therealong (e.g., production stations in an assembly line). As the mold bases 52 or other panel support devices are moved from one position to another by the conveyor 94, various manufacturing steps or operations can be performed sequentially at one or more positions. While FIG. 10 shows a single linear conveyor 94, it should be understood that embodiments usable within the scope of the present disclosure can include any number and configuration of conveyors or other transport means able to move and/or position molds and/or panel components. For example, conveyors can transport components from supply areas to manufacturing stations, and to other locations, as needed, to at least partially automate the manufacturing process.

To properly position and/or locate multiple finish elements in a spaced relation within a mold base 52, a placement mechanism 96 can be used. The placement mechanism 96 shown in FIG. 10 includes an actuator 98 usable to move the placement mechanism toward and away from the mold bases 52 (e.g., vertically) using an actuator mechanism 98. The position of the finish elements within the placement mechanism 96 can determine the location where the finish elements are deposited in the mold bases. Alternatively or additionally, the location of locator pins, ridges, or a jig within the mold base 52 can facilitate placement.

In one embodiment, the placement mechanism 96 can use mechanical gripping members to retain and release finish elements. In another embodiment, the placement mechanism 96 can include one or more vacuum support devices usable to retain finish elements in association therewith. After the finish elements have been located with respect to the mold base, the conveyor 94 can move the mold base into a desired position relative to a screed 100 and screed actuator mechanism 102. The screed can be moved by the actuator mechanism 102 into association with the back faces of the finish elements to permit deposition of particulate material through the screed openings. While FIG. 10 shows a planar screed member 100, it should be understood that particulate deposition members having any shape and/or dimensions can be used, including a cylindrical screed member for rotary movement as the mold base and/or screed member move laterally relative to one another. The particulate material can be delivered by a feed and applicator mechanism that extends to the screed member and deposits a measured quantity of particulate through the openings thereof.

In an embodiment, a planar or rotary compaction mechanism 104, shown having open cell polymer or any other suitable deformable body 106 in association therewith, can be used to engage the back faces of the finish elements to compact the particulate material within the spaces between finish elements. The deformable body 106 is shown mounted to a press plate 108 that can be moved by actuating shafts and/or posts 110. The deformable body 106, whether of planar or rotary character, can engage the panel elements and achieve compression or compaction of particulate material, while also retaining the finish elements in place. After the compaction operation has been completed the compaction mechanism can be raised to permit movement of the mold base, e.g., to a subsequent manufacturing station for application of polymeric foam.

A polymeric foam mixing and application system 112 for support and movement of a polymeric foam mixing and applicator mechanism 68, is shown being supported and/or moved by an actuator mechanism having one or more actuating posts 116, relative to a panel being manufactured. The polymeric foam mixing and applicator mechanism 68 can apply a contiguous layer or substrate of polymeric foam thermal insulating and moisture proofing material to a panel, either during movement of the panel by the conveyor or during movement of the polymeric foam mixing and applicator mechanism 68, or during movement of both devices, as determined by the design of the panel manufacturing system.

After a polymeric substrate has been applied, and before the polymeric material cures, e.g., by the chemical reaction of its polymer constituents, a backing or sheathing panel 14, carried by a mold closure member 70, can be moved into surface-to-surface contact with the uncured polymeric material. FIG. 10 shows a sheathing panel positioning mechanism 120 having one or more support and actuation posts 122, to which a sheathing panel support and positioning mechanism 124 is mounted. The sheathing panel support and positioning mechanism 124 is shown having a recess or pocket 125 within which the backing or sheathing panel 14 can be received. As described previously, the backing or sheathing panel 14 may be composed of any number of suitable panel materials, such as plywood, OSB, particle board, polymer, or any combinations of these materials. Backing or sheathing panels may be moved and/or retrieved from a supply or storage site, such as by lateral movement of the backing or sheathing panel positioning mechanism 120, and then positioned on the polymer substrate. The backing or sheathing panel positioning mechanism 120 can be actuated to apply a predetermined mechanical pressure to the sheathing panel 14, thereby subjecting the panel being manufactured to a desired compression pressure during curing of the polymeric material. In an embodiment, a layer of release material, such as paper or a polymer film, can be positioned between between the mold closure member 70 and the backing or sheathing panel 14, to prevent uncured polymeric material from contacting the mold closure member during compression. Application of mechanical pressure to the panel can cause polymeric material to penetrate to a desired extent into the compacted particulate material, to become bonded with the finish elements, and to become bonded to the backing or sheathing panel 14. This mechanical pressure can also cause the polymeric material to have a density that enhances the structural integrity and water and air imperviousness of the resulting panel. The finished panels, thus manufactured, are then in the form of integrated panel substrate structures that will retain their structural integrity and provide many years of efficient service as structural components, with a usable life as long or longer than that of conventional masonry walls and other components of a building structure. The composite panels, due to the presence of the polymeric substrate, can provide efficient thermal insulation for a surface and can also serve as an efficient barrier to air infiltration and an efficient moisture barrier to prevent intrusion of water.

In an embodiment, completed panels can be dusted and cleaned, subjected to final inspection for quality control, and packaged. The size and light weight of each panel can enable user friendly, easy installation. For example, an embodied panel can have a height of 4 feet and a width of 19 and 3/16 inches, with a thickness of 1.5 inches; however, it should be noted that other dimensions can be used, as desired. User friendly dimensions that enable easy manipulation and installation of panels can facilitate proper interlocking of adjacent panels and proper installation over framework and/or other structural elements. Additionally, embodied panels can be cut, e.g. using masonry cutting blades, and could further be attached to sub-surfaces, e.g., using screws, adhesives, or other types of fasteners. Screws or similar fasteners can be placed in the spaces between finish elements (which, in an embodiment, can be spaced in a manner consistent with the 16" or 24" on-center frequency of wall stud members in a conventional wall framework). Screw heads and adjacent panel joints can be treated with caulking (e.g., clear silicone), and while such caulking material remains uncured, particulate material can be applied to bond to the caulk. Use of pliant and resilient caulk, can allow for expansion and contraction of panel components while maintaining water resistance of panel joints. Any residual particulate material can be brushed or washed from the panel surface once caulking has cured.

Ends and edges of embodied panels can be manufactured for abutting relation with adjacent panels above, below and/or at the sides. Each panel end can be manufactured to interfit with an opposing end of an adjacent panel. This feature can allow for a constant and consistent blending of the finish materials of the panels. Corner installations can be formed by fitting the ends of panels flush with the corner of the building structure, and by filling any "missing brick" spaces in the manner described previously. In the event that a framework space is too small to receive a complete panel, panels may be cut to size, e.g., using a masonry saw to avoid damage to the finish elements.

In an embodiment, all materials used in the manufacture and installation of embodied panels can be waterproof, and weather resistant, thus requiring little or no maintenance. The mortar or brick cracking that is typically experienced during the service life of conventional brick and mortar wall installations will not typically be expected when using embodied panels. Additionally, repair of embodied panels can be accomplished quickly and easily, such as through replacement of individual surface-mounted finish elements, since unlike conventional surfaces, the finish elements are not structurally integral to the surface. The embodied panels can also permit movement of components over time, without resulting in the formation of cracks.

In addition to the construction of new walls and/or surfaces, embodied panels can also be applied over old siding, conventional sheathing, pre-fabricated panel systems, bare stud framework and, virtually in any place on any surface, in virtually any type of construction.

In one specific embodiment, the panel construction process can be nearly entirely automated. For example, finish elements can be stored in a structure capable of containing numerous finish elements, arranged in a manner suitable for application to a completed panel. In an embodiment, such a structure can include a "magazine," having orifices (e.g., columns) within which multiple, stacked finish elements can be placed, resembling a three-dimensional jig. Alternatively, the magazine could lack interior walls and/or separation members, and could simply include an external frame (e.g., a box) within which stacks and/or columns of finish elements are arranged. The columns of finish elements can be positioned such that the stacked finish elements are arranged in a manner corresponding to that of a finished panel (e.g., offset rows of thin brick elements having spaces therebetween for receiving particulate material). In a further embodiment, the "magazine" can include actuator and/or biasing members at the base of one or more columns, for urging stacks of finish elements upward for acquisition and use. For example, spring-biased rods/pistons, rods/platforms raised via a scissor lift, or other similar actuation/biasing members could be used. Alternatively or additionally, the entire floor of the magazine could be raised to position the finish elements within multiple columns at the upper surface thereof.

Independent of whether a magazine is used, or whether finish elements are arranged manually or using other means, a set of arranged finish elements (e.g., each of the finish elements usable to produce a single panel, arranged in a manner corresponding to the arrangement of elements on the completed panel) can be simultaneously retained by a single apparatus, such as a vacuum device, which can be used to lift and/or otherwise move the finish elements from the magazine or other storage area. The vacuum can then be moved (e.g. laterally) to transport the finish elements to a second step of the manufacturing process, or alternatively, the finish element storage can be moved and additional apparatus for manufacturing panels can be moved into association with the vacuum.

As such, after a set of arranged finish elements are bought into association with a vacuum device, suction from the vacuum device can retain the finish elements such that the finish elements can occupy a first portion of a vacuum frame, thus defining a first "zone" of the vacuum that is occupied by the finish elements, and a second "zone" defined by the spaces between the finish elements. While suction against the finish elements is maintained, the vacuum can be moved from the magazine into association with a particulate source (e.g., a tray and/or similar container having particulate matter therein), and/or the magazine and particulate source can be moved into association with the vacuum. Suction from the vacuum device can then cause the accumulation of particulate material in the spaces between finish elements (e.g., the second "zone" of the vacuum device), while the presence of the finish elements prevents accumulation of particulate material in the first zone.

In an embodiment, the vacuum device can be used to retain one or more frame members, e.g., about the edges thereof, before acquiring the finish elements, after acquiring the finish elements, or after acquiring the particulate material, as desired. The frame member(s) can define a border that retains the particulate materials about the edge of the assembly.

Once the finish elements and particulate material (and the frame member(s), if applicable) have been retained by the vacuum device, the vacuum device can be placed in association with a mold, and suction from the vacuum device can be discontinued. The finish elements and particulate material are thereby deposited within the mold in an arrangement suitable for immediate application of polymeric substrate materials and sheathing/backing, as described previously, thereby significantly reducing the time required to position finish elements and particulate material when compared to other manufacturing and assembly methods. If frame members are also retained by the vacuum, the frame can similarly be deposited within and/or into association with the mold, such that the frame retains the edges of the panel components (e.g., the particulate material) in a desired position during the molding process. Embodiments of the process described above can prepare a panel for the molding/compressing process in as little as one minute, or less.

Figure 13B:
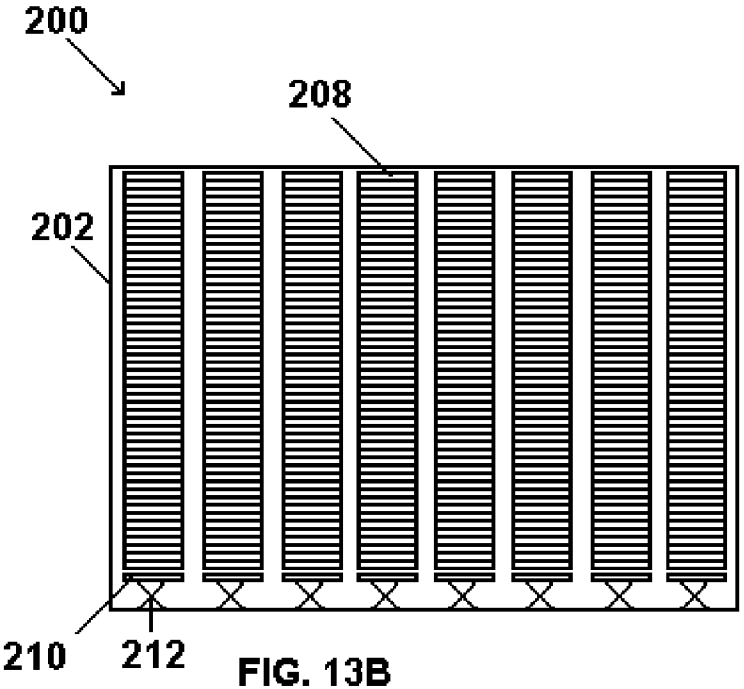
FIG. 13B shows a diagrammatic side sectional view of the storage receptacle of FIG. 13A.
Figure 13A:
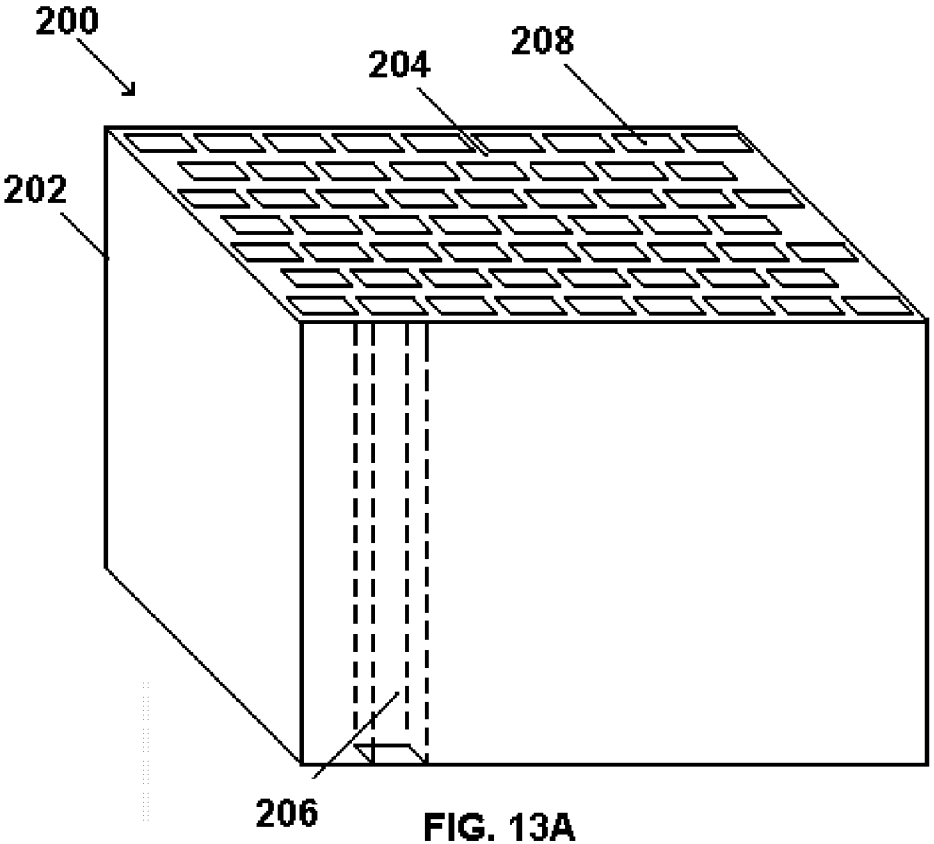
FIG. 13A shows an isometric view of an embodiment of a finish element storage receptacle usable in connection with an embodiment of a method for manufacturing a panel.

FIGS. 13A and 13B show an embodiment of a finish element "magazine" 200 usable within the scope of the present disclosure. Specifically, FIG. 13A shows an isometric view of the magazine 200, while FIG. 13B shows a diagrammatic side sectional view thereof. The depicted embodiment includes a rigid frame or body 202 (e.g., formed from wood, metal, plastic, composite, or similar generally durable materials), shown having a generally rectangular shape; however, it should be understood that a magazine having any shape and/or dimensions could be used, or in other embodiments, other apparatus or methods for storing and/or arranging finish elements could be used.

The interior of the magazine 200 can include a removable jig 204 and/or integral/removable interior wall components, thereby dividing the interior into a plurality of columns 206, each of which is sized to contain a stack of finish elements 208. In other embodiments, internal spacing elements can be omitted, and the finish elements 208 can simply be positioned in columns and/or stacks having a desired orientation. At the lower end of each column 206, a platform and/or similar support member 210 can be positioned, the platform 210 being movable upward and downward within its respective column 206 using a scissor lift 212. In other embodiments, the platform 210 could include a rod, piston, or similar elongate member. Alternatively, platforms and/or support members could be omitted, and scissor lifts 212 or similar actuating and/or biasing apparatus could contact and move stacks of finish elements 208 directly. While FIG. 13B depicts scissor lifts 212 used to move the stacks of finish elements 208 upward, it should be understood that the scissor lifts 212 are shown as a single exemplary embodiment, and that springs or other automatic biasing members could be used, as could hydraulic, pneumatic, and/or other mechanical apparatus. Additionally, while FIG. 13B depicts a plurality of platforms 210 associated with respective columns in the magazine 200, in other embodiments, a single platform beneath each column of finish elements 208 could be raised, thereby lifting each stack of finish elements, and in an embodiment, any interior walls and/or jigs positioned within the interior of the magazine 200. In other embodiments, a single platform could include slots and/or orifices to accommodate the passage of generally stationary interior walls.

During typical use, the platform(s) and associated actuating elements can be used to raise each stack of finish elements 208, such that the uppermost finish elements in each stack are accessible to a vacuum apparatus. Once the uppermost finish elements are brought into association with the vacuum apparatus and removed from the magazine, the platform(s) and actuating elements can then lift each stack of finish elements to position the subsequent finish element of each stack at the upper surface of the magazine. In an embodiment, each column of stacked finish elements can include approximately sixty individual finish elements, and a magazine can contain approximately 2500 finish elements, in sum.

Figure 14B:
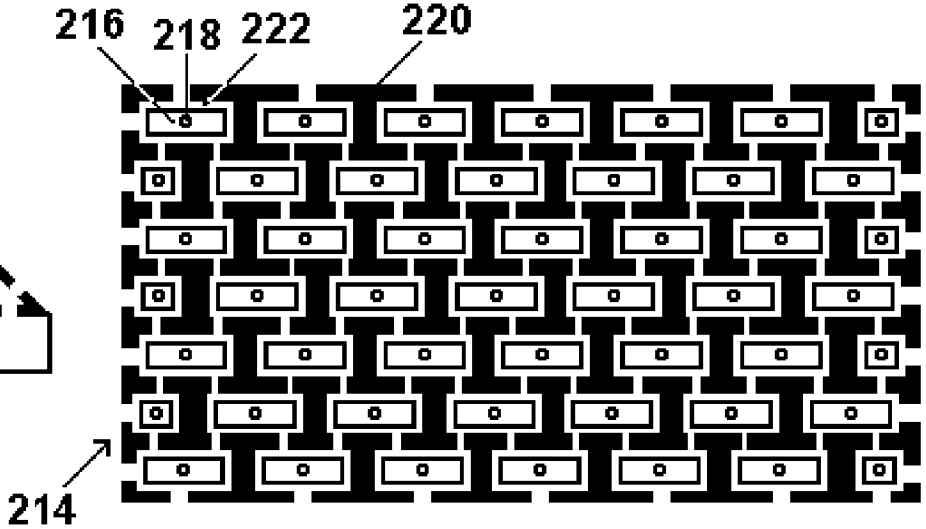
FIG. 14B depicts a top plan view of the frame of FIG. 14A, with stand-off members placed thereon.
Figure 14A:
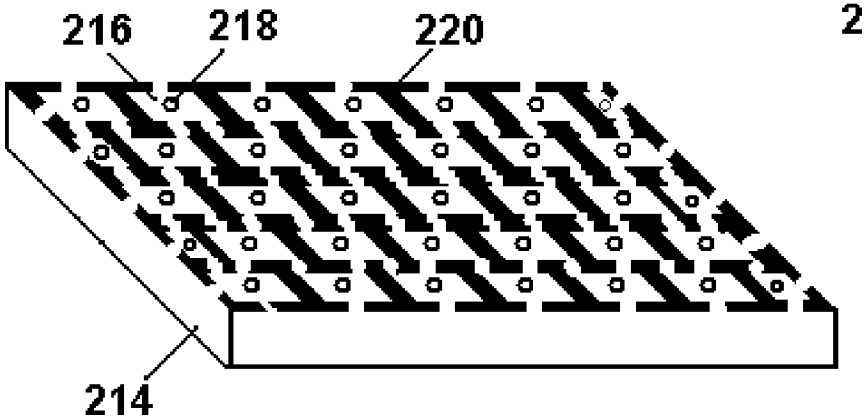
FIG. 14A depicts an isometric view of an embodiment of a frame usable with a vacuum apparatus in connection with an embodiment of a method for manufacturing a panel.
Figure 14C:
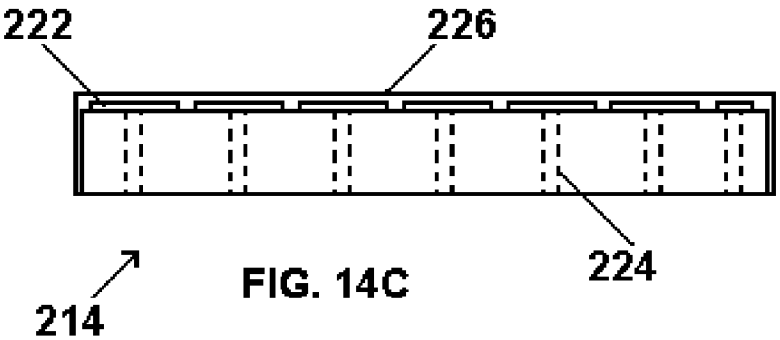
FIG. 14C depicts a diagrammatic side sectional view of the frame of FIG. 14B, with an overlaying screen placed thereon.

FIGS. 14A, 14B, and 14C depict an embodiment of a frame 214, usable with a vacuum apparatus (not shown), e.g., to retrieve finish elements from a magazine, such as that shown in FIGS. 13A and 13B, or a similar storage area, to retrieve particulate material within spaces between the finish elements, and to deposit the finish elements and particulate material into a mold or similar receptacle for subsequent manufacturing steps. Specifically, FIG. 14A shows an isometric view of the frame 214, FIG. 14B shows a top view, and FIG. 14C shows a diagrammatic side sectional view thereof. The frame 214 can include various inlets and outlets (not shown), as known in the art, for accommodating connection to a vacuum apparatus and/or connections for engaging to a pulley system and/or similar apparatus for moving the frame 214.

The depicted frame 214 is shown having a generally rectangular shape (e.g., with four sidewalls and a top surface), the top surface having multiple element receiving regions 216 thereon. Each element receiving region 216 can include a bore or orifice 218 therein, for engagement with a vacuum apparatus and/or for transmitting suction from a vacuum apparatus therethrough. As such, suction provided by a vacuum apparatus, via the bores 218, will tend to draw finish elements to the element receiving regions 216. Between adjacent element receiving regions 216, and between the outermost element receiving regions 216 and the edges of the frame 214 are a plurality of slots 220. Suction from a vacuum apparatus associated with the frame 214 can also draw material into and/or through the slots 220. In an embodiment, a first vacuum apparatus can be provided in association with the bores 218 in the element receiving regions 216, while a second vacuum apparatus can be provided in association with the slots 220; however, it should be understood that a single vacuum apparatus can be used, the presence of finish elements within the frame 214 effectively defining multiple "zones" affected by the single vacuum apparatus, as described above and below.

FIG. 14B depicts the frame 214 having stand-off members 222 positioned over each of the element receiving regions 216, to effectively space any overlaying material from the bores 218. FIG. 14C depicts vacuum tubes 224 associated with each element receiving region 216, for transmitting suction from a vacuum apparatus to each region 216 via the bores 218 (shown in FIGS. 14A and 14B). FIG. 14C further depicts a screen 226 or similar layer of overlaying material placed over the frame 214, and spaced from the bores 218 due to the presence of the stand-off members 222. The screen 226 provides a generally smooth, flat, contiguous surface for receiving finish elements and particulate material thereon when suction from a vacuum apparatus is applied therethrough.

Figure 15A:
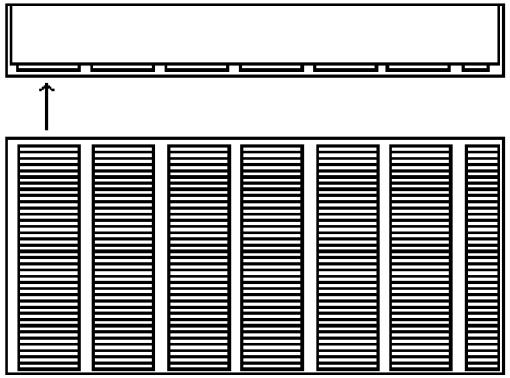
FIG. 15A depicts a diagrammatic side view of a frame usable with a vacuum apparatus in association with a finish element storage receptacle for use with an embodiment of a method for manufacturing a panel.

FIGS. 15A through 15E illustrate a series of steps usable in one embodiment of a method for manufacturing a panel using a vacuum apparatus to at least partially automate the transfer of finish elements and particulate material from respective storage areas to a mold base. Specifically, FIG. 15A depicts a magazine 300 that can be of identical or similar construction to the magazine shown in FIGS. 13A and 13B, positioned beneath a frame 302 adapted for association with a vacuum apparatus (not shown), such that suction from the vacuum apparatus can be transmitted through the frame 302 to adhere panel components thereto, e.g., during panel assembly and transport of panel components to a mold.

The magazine 300 is shown having multiple columns and/or stacks 304 of finish elements therein, which can be arranged in a manner corresponding to the arrangement of finish elements on a completed panel, as described previously, while the frame 302 is shown having an external surface 306 (e.g., a screen or similar member) suitable for receiving panel components during assembly and/or transport. In use, suction from the vacuum apparatus, applied through the frame 302, can draw the uppermost layer of finish elements 308 to the surface 306. Due to the arrangement of the finish elements 308 within the magazine 300, the finish elements 308 are positioned on the surface 306 in substantially the same arrangement, such an arrangement corresponding to the arrangement of finish elements on a completed panel. The finish elements 308 can be drawn to defined regions of the frame 302, via appropriate bores therein and/or or similar conduits/features for engagement with conduits of the vacuum apparatus, and in an embodiment, stand-off members for spacing the surface 306 from the body of the frame 302, thereby defining a first vacuum zone, indicated by the arrow 310.

Figure 15B:
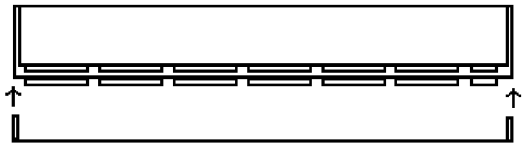
FIG. 15B depicts the frame of FIG. 15A in association with panel frame elements for use with an embodiment of a method for manufacturing a panel.

FIG. 15B depicts the frame 302 after the finish elements 308 have been associated with the surface 306 thereof using suction from an associated vacuum device. The frame 302 is shown above a receptacle containing panel border members 312. While in some embodiments, use of panel border members 312 can be omitted, panel border members 312 can provide a barrier, e.g., about the perimeter of the panel components, to retain particulate material within a defined region—specifically, so that particulate material captured by the vacuum apparatus does not extend beyond the intended edge of the completed panel. Use of the vacuum apparatus to removably retain panel border members 312 against the surface 306 creates a transferable barrier, such that the panel border members 312 can be deposited into a mold with the assembled panel components to continue retaining the particulate material in a desired position until the molding process has been completed. Specifically, FIG. 15B illustrates suction through a second vacuum zone in the frame 302, represented by the arrows 314, usable to draw the panel border members 312 to corresponding locations on the surface 306 (e.g., proximate to the edge thereof, at a location corresponding to the edge of a completed panel). While FIG. 15B depicts panel border members 312 intended to be associated with a region of the surface 306 corresponding to the intended edges of a completed panel, in various embodiments, border members could be associated with portions of the surface 306 corresponding to interior portions of the completed panel, depending on the intended configuration thereof. Additionally, it should be understood that while reference to distinct vacuum zones 310, 314 is made, and that multiple vacuum apparatus (e.g., one vacuum apparatus per zone) could be separately actuated during respective steps of the assembly and manufacturing process, in an embodiment, a single vacuum apparatus can be used. For example, the presence of the finish elements 308 on the surface 306 prevents suction from the vacuum apparatus from passing through occupied portions of the surface 306, such that subsequent materials will generally only be drawn to other, unoccupied regions of the surface 306. As such, the presence of the finish elements 308 effectively creates a second vacuum zone, even though a single vacuum apparatus could be used to apply suction through the entirety of the surface 306.

Figure 15C:
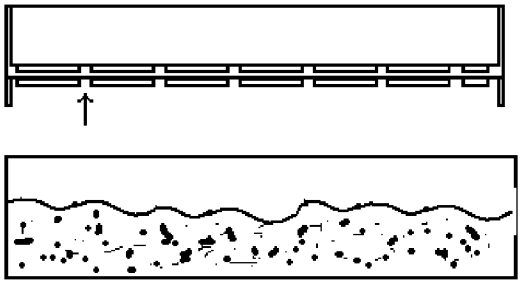
FIG. 15C depicts the frame of FIG. 15B in association with a particulate material storage receptacle for use with an embodiment of a method for manufacturing a panel.

FIG. 15C depicts the frame 302 after both the finish elements 308 and panel border members 312 have been associated with the surface 306 thereof using suction from an associated vacuum device. The frame 302 is shown above a receptacle 316 containing particulate material 318. Use of an associated vacuum apparatus to apply suction through the frame 302, specifically, a third vacuum zone thereof, represented by the arrow 320, thereby draws particulate material 318 to regions between the finish elements 308, and between the outermost finish elements and the panel border members 312. As described above, the third vacuum zone 320 can be defined by the presence of the finish elements 308 and panel border members 312, which prevent suction, from the vacuum apparatus, from drawing particulate material to portions of the surface 306 that are occupied by the finish elements 308 and border members 312. As discussed previously, while reference is made to a third vacuum zone 320, each of the vacuum zones 310, 314, 320 could have suction applied thereto using separate apparatus, a single apparatus capable of applying suction to discrete portions of the frame 302, or a single apparatus that applies suction through the entirety of the surface 306 while the presence of panel components thereon creates effective vacuum zones by preventing the vacuum apparatus from associating additional components with portions of the surface 306 that are occupied and/or obstructed.

While FIGS. 15A through 15C illustrate the panel border members 312 being associated with the frame 302 after association of the finish elements 308 and before association of the particulate material 318 therewith, it should be understood that the above steps could be performed in various sequences without departing from the scope of the present disclosure. For example, the panel border members 312 could be associated with the frame 302 before any panel elements (e.g., the finish elements 308 and/or the particulate material 318) are associated therewith, or alternatively, the panel border members 312 could be associated with the frame 302 after associating the frame 302 with both the finish elements 308 and particulate material 318, such that the border members 312 displace excess particulate material to define the intended edge of a completed panel. Panel border members 312 could also be associated with the frame 302 after association of the finish elements 308 therewith, and before association of the particulate material 318, as described above.

Figure 15D:
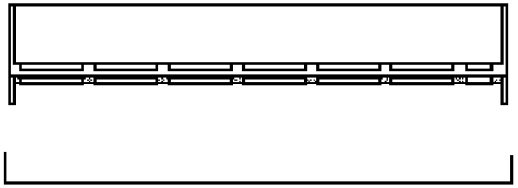
FIG. 15D depicts the frame of FIG. 15C in association with a mold for use with an embodiment of a method for manufacturing a panel.

FIG. 15D depicts the frame 302 after association of the finish elements 308, panel border members 312, and particulate material 318 therewith. When the processes illustrated in FIGS. 15A through 15C and described above and performed, the panel elements 308, 318 are arranged on the surface 306 in a manner corresponding to that of a finished panel. As such, FIG. 15D depicts the frame 302, the associated panel elements 308, 318, and the panel border members 312 positioned above a mold base 322, such that the frame 302 can be lowered and/or otherwise positioned in association with the mold base 322 to deposit the panel elements 308, 318 and border members 312 therein, in substantially the same orientation.

Figure 15E:
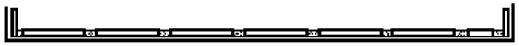
FIG. 15E depicts the mold of FIG. 15D after deposition of panel components therein for use with an embodiment of a method for manufacturing a panel.

FIG. 15E depicts the mold base 322 after suction from the vacuum apparatus has been ceased, thereby causing the finish elements 308, particulate material 318, and panel border members 312 to be deposited into the mold base 322 in an orientation corresponding to that in which the finish elements 308, particulate material 318, and border members 312 were retained on the frame 302 (shown in FIGS. 15A through 15D), and to that of a completed panel. After depositing the finish elements 308, particulate material 318, and panel border members 312 within the mold base 322, subsequent manufacturing steps (e.g., the application of a polymeric substrate material and a sheathing/backing layer, and use of compression) can be performed in the manner described previously. As such, uncured polymeric material can be permitted to penetrate into the particulate material 318 to form a secure bond between each of the panel elements as it cures, while the panel border members 312 prevent movement of the particulate material 318 beyond the intended edge of the completed panel prior to the curing of the polymeric substrate. After the molding process has been completed, the panel border members 312 can be removed.

Figure 11:
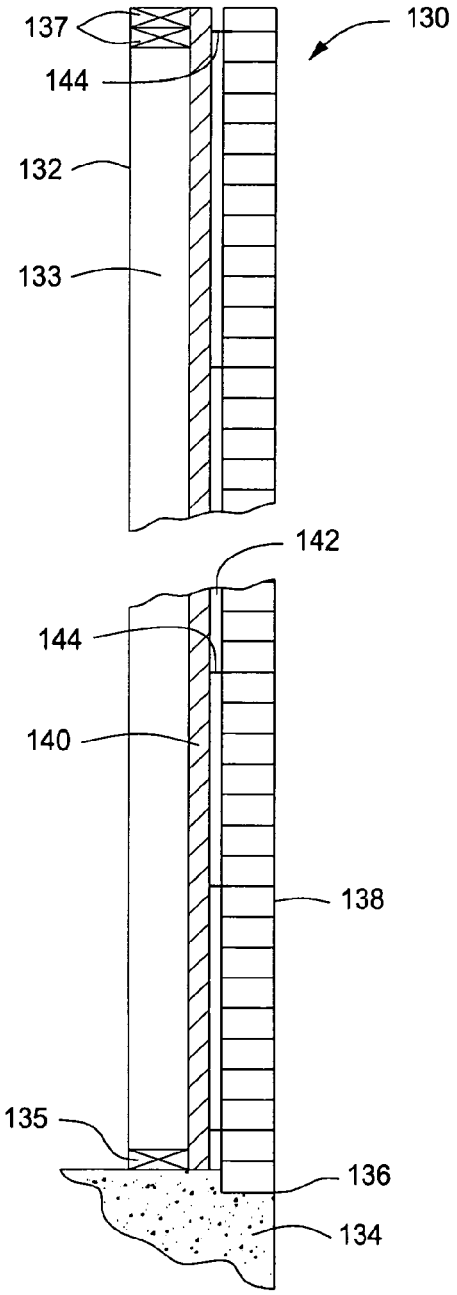
FIG. 11 (PRIOR ART)
FIG. 11 is a vertical sectional view showing a conventional exterior wall construction.

FIG. 11 is a vertical sectional view illustrating a conventional brick veneer wall structure of a building, shown generally at 130, representing the prior art. The wall structure 130, as illustrated by the sectional view, incorporates a wall framework 132 that is shown to be supported by a foundation 134. The wall framework 132 incorporates stud members 133, sill members 135, and cap members 137. It should be noted that the foundation 134 for the brick veneer wall of FIG. 11 must extend outwardly beyond the wall framework 132 to provide a support ledge 136 for the brick and mortar veneer wall material 138. Sheathing panel material 140 is fixed to the framework 132 to provide for thermal insulation and to provide a moisture barrier. During current construction practices, the sheathing panel joints, between sheathing panels, are not typically sealed in any manner, so in humid regions, moisture can penetrate the sheathing to a sufficient extent to be potentially damaging to the typically wood wall framework. Also, the conventional brick veneer wall structure 130 typically defines an air gap or vent 142 between the interior surface of the brick veneer wall 138 and the insulation and moisture resistant sheathing panels that are fixed to the exterior of the framework. Additionally, the conventional brick veneer wall employs mechanical tie members 144 to provide the brick and mortar wall with lateral support by the building framework.

Figure 12:
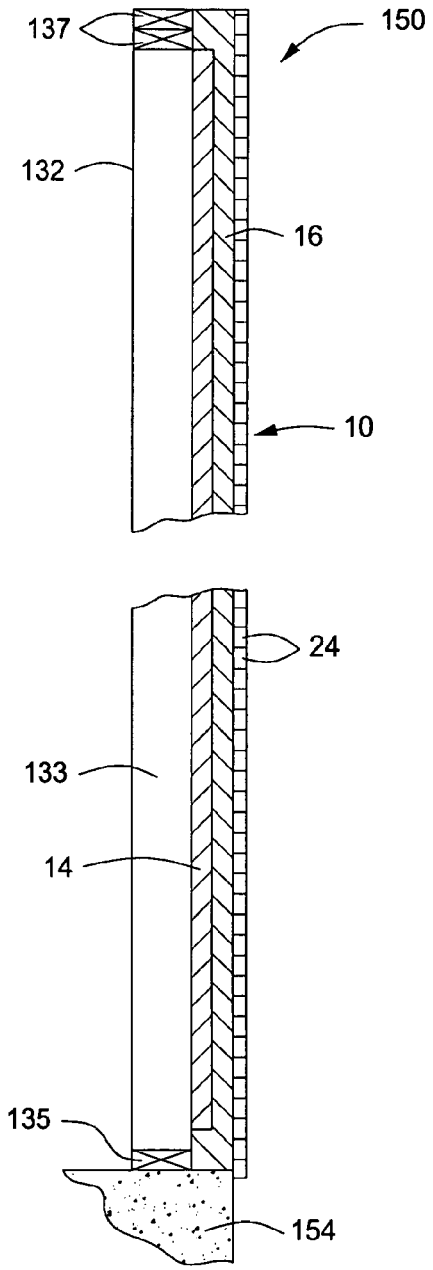
FIG. 12 is a vertical sectional view showing an embodiment of a panel usable within the scope of the present disclosure.

In comparison with the brick veneer wall structure of FIG. 11, the vertical sectional view of FIG. 12 shows a wall structure generally at 150 that is constructed in accordance with one or more embodiments usable within the scope of the present disclosure. The exterior wall structure 150 is shown associated with a conventional wall framework 132, having framework components that are essentially the same as described in connection with FIG. 11. The wall framework 132 is supported by a foundation 154 that can be of less expensive construction as compared with the foundation of FIG. 11 in that it does not include a brick support ledge. The foundation 154 can be slightly smaller, as compared with the foundation 134 of FIG. 11, because it does not need to extend significantly beyond the outer limits of the building framework 132. The foundation 154 can be designed to support less weight as compared with the foundation 134 of FIG. 11, because it need not be designed to support the weight of a conventional brick and mortar wall, thus further minimizing the cost of the foundation. The resulting wall construction of FIG. 12 can be much thinner than the thickness of a conventional brick veneer wall and can be of significantly less weight, thus providing for significant cost savings without detracting from the durability and longevity of the wall. Embodied panels 10 can be fixed to the wall framework 132 by means of fasteners, such as screws or adhesive, can provide thermal insulation characteristics, can serve as structural enhancement for the framework structure of the wall, and can provide a moisture and air barrier. Fasteners that penetrate the panels can be located in the spaces between finish elements, and engage within the wall studs or other structural members of the wall framework 132. If desired, the panels 10 may be applied over existing wall materials, such as the conventional sheathing 140 of FIG. 11. The panels, as discussed in detail above, can support thin brick or other facade members 24 which define the outer surface of the completed composite paneled wall 150. Significant savings in time, labor and materials can thereby be gained through employment of the present invention. The resulting completed wall construction can withstand equal or greater wind loads as compared with that of a conventional brick veneer wall. Moreover, as building settling and thermal movement occurs over time, conventional brick veneer walls tend to crack and must be repaired. Embodiments of the preset panels can have significant flexibility, sufficient to flex when building structure movement occurs, without developing significant cracks.

While various embodiments of the present invention have been described with emphasis, it should be understood that within the scope of the appended claims, the present invention might be practiced other than as specifically described herein.

What is claimed is:

1. A panel usable for construction of a surface, the panel comprising:

at least one finish element, wherein said at least one finish element comprises magnesium oxide, and wherein said at least one finish element is adapted to provide the panel with a reduced thickness, a reduced weight, or combinations thereof a backing material, wherein the backing material comprises magnesium oxide and is adapted to further provide the panel with a reduced thickness, a reduced weight, or combinations thereof and a liquid polyurethane introduced between the finish element and the backing material, wherein upon hardening the polyurethane forms a structural substrate having a first side and a second side, further wherein upon the hardening of the polyurethane the backing material is adhesively bonded to the first side without an intervening layer and upon the hardening of the polyurethane the finish element is adhesively bonded to the second side without an intervening layer.

2. The panel of claim 1, further comprising a particulate material positioned on the first side of the layer of substrate material between a first finish element and a second element, wherein the layer of substrate material bonds the particulate material to said at least one finish element and the backing material.

3. The panel of claim 2, wherein the layer of substrate material at least partially occupies interstices between particles of the particulate material.

4. The panel of claim 2, wherein the particulate material comprises a binder composition.

* * * * *